US005557391A

United States Patent [19]

Kato et al.

[11] Patent Number: 5,557,391

[45] Date of Patent: Sep. 17, 1996

[54] IMAGE FORMING APPARATUS FOR PRODUCING DUPLEX OR COMPOSITE PRINTS WITH IMPROVED EFFICIENCY BY FEEDING SHEETS AT SHORTENED INTERVALS

[75] Inventors: Tomokazu Kato, Toyokawa; Keiichi Nomura, Amagasaki; Kentaro Nagatani, Toyohashi; Syuzi Maruta, Toyokawa; Yoshiaki Takano, Toyohashi; Kazuhiro Araki; Takashi Noda, both of Okazaki, all of Japan

[73] Assignee: Minolta Camera Kabushiki Kaisha, Osaka, Japan

[21] Appl. No.: 198,520

[22] Filed: Feb. 17, 1994

[30] Foreign Application Priority Data

Feb. 20, 1993 [JP] Japan ..... 5-055145

[51] Int. Cl.[6] ..... G03G 15/00

[52] U.S. Cl. ..... 355/319; 271/3.15; 355/309

[58] Field of Search ..... 355/24, 313, 308–309, 355/318–320; 271/3.15

[56] References Cited

U.S. PATENT DOCUMENTS

| | | | |
|---|---|---|---|
| 4,655,882 | 4/1987 | Okuda et al. | 355/319 |
| 4,708,462 | 11/1987 | Stemmle | 355/24 |
| 4,788,575 | 11/1988 | Ito et al. | 355/319 |
| 4,845,528 | 7/1989 | Aoki et al. | 355/210 |
| 4,849,796 | 7/1989 | Murakami | 355/206 |
| 4,864,368 | 9/1989 | Muramatsu | 355/309 |
| 4,924,275 | 5/1990 | Nelson | 355/319 |
| 5,034,771 | 7/1991 | Makita | 355/204 |
| 5,095,342 | 3/1992 | Farrell et al. | 355/319 |
| 5,165,675 | 11/1992 | Kanaya | 271/3.1 |
| 5,257,064 | 10/1993 | Okamoto | 355/24 |

FOREIGN PATENT DOCUMENTS

| | | |
|---|---|---|
| 52-10142 | 1/1977 | Japan . |
| 4-81866 | 3/1992 | Japan . |

OTHER PUBLICATIONS

Japanese Publication Kokai No. 52–10142, published Jan. 26, 1977.

*Primary Examiner*—Thu Anh Dang

*Attorney, Agent, or Firm*—Willian Brinks Hofer Gilson & Lione

[57] ABSTRACT

An image forming apparatus includes a feeder for feeding a new paper accommodated in a feeding cassette, an image forming device which forms an image on the paper fed by the feeder, an intermediate container which temporarily accommodates the paper fed by the feeder and having the image thereon, a refeeder which refeeds the accommodated paper from the intermediate container to form an image on the paper again, a detector which detects presence or absence of paper to be fed by the refeeder for image formation, and a controller which effects a change-over from the paper feeding operation by the refeeder to the paper feeding operation by the feeder when the detector detects the absence of paper to be refed or forbids the paper feeding operation by the refeeder until the detector detects the absence of paper to be refed after the paper has been accommodated in the intermediate container.

14 Claims, 20 Drawing Sheets

J

S521
SE7 offedge ?
NO
YES
decrement feed counter 2
S523
set oldest paper data address
S525
S531
paper data effective ?
NO
YES
S533
paper data shows feed outlet main body ?
NO
YES
S535
next paper data set
S537
paper data←invalid
return (duplex copy· set number 2)

newest area

| | | | | | | | |
|---|---|---|---|---|---|---|---|
| effective main body (5) | effective main body (4) | effective main body (3) | effective main body (2) | invalid main body (1) | effective duplex (5) | invalid duplex (4) | invalid duplex (3) |

IMAGE FORMING APPARATUS FOR PRODUCING DUPLEX OR COMPOSITE PRINTS WITH IMPROVED EFFICIENCY BY FEEDING SHEETS AT SHORTENED INTERVALS

BACKGROUND OF THE INVENTION

1. Field of the Invention

The present invention relates to apparatus having the function of forming an image on paper which is fed initially and thereafter forming another image on the same paper which is fed again.

2. Description of the Related Art

Copying machines are already provided which have the function of forming an image on paper fed from a feed outlet (i.e., an outlet for feeding paper having no image formed thereon, hereinafter referred to as the "initial feed outlet") of the main unit, thereafter temporarily holding the paper as accommodated in an intermediate containing portion and subsequently feeding the paper again from a refeed outlet (i.e., a feed outlet of the intermediate containing portion) to thereby form another image on the same paper (duplex copying function or composite copying function).

Also provided are copying machines equipped with an automatic document feeder (ADF).

Copying machines are further available which have such a function that when the absence of paper in a paper tray is detected during feeding, the feed outlet is changed over from the tray to another paper tray containing paper of the same-size to continue the feeding operation.

Further available are copying machines having the duplex copying function and so adapted that upon the detection of feeding of a specified number of paper sheets from the initial feed outlet in the main unit for first face copying, a command is given to refeed the paper from the refeed outlet of the intermediate containing portion so as to shorten the waiting time before the start of second face copying.

With image forming apparatus having the function of repeatedly forming an image on the same paper like the duplex copying function, it is desired to improve the productivity of prints, so that it is required to feed paper sheets at shortened intervals as a method of achieving the improvement.

The paper feeding intervals to be shortened include not only the interval between the specified number of paper sheets but also the interval after the completion of initial feeding of the specified number of sheets for first face printing and until the initiation of refeeding for second face printing, and the interval after the completion of refeeding for the second face printing and until the initiation of the next initial feeding for the first face printing.

However, if an attempt is made to merely shorten the interval until the initiation of refeeding for the second face printing and the interval until the initiation of the next initial feeding for the first face printing without giving consideration, for example, to the specified number of prints to be made or to the length of path of transport, there is the likelihood of a collision occurring between the initially fed paper and the refed paper at a junction of the transport path from the initial feeding side and the transport path from the refeeding side, giving rise to a transport trouble.

Discrimination data indicating the feed source (initial feed outlet/refeed outlet) is given to each sheet of paper to make distinction as to whether the printed sheet is to be discharged from the machine or to be accommodated in the tray of the intermediate containing portion. Suppose jam troubles occurring are corrected based on the discrimination data. When a jam occurred before a fifth sheet P5 having images of documents D1, D2 printed on the respective front and rear faces thereof is discharged from the machine as shown in FIG. 19 (the specified number of prints in the illustrated case: 5), the jam is corrected based on the interpretation that the documents D1, D2 have not been copied. More specifically, a command is given to the effect that the documents D1, D2 are to be returned to a document tray 31. Accordingly, in the case where a sheet bearing a print of document D3 on its first face remains in the tray 25 of the intermediate containing portion as illustrated, the system as it is permits occurrence of the trouble that an image of document D1 is printed on the second face of the sheet.

SUMMARY OF THE INVENTION

The main object of the present invention is to provide an apparatus which is adapted to produce duplex (or composite) prints with an improved efficiency by feeding sheets of paper at shortened intervals.

Another object of the invention is to provide an apparatus which is operable free of the above problems that would result from the shortened paper feeding intervals.

These objects of the present invention are overcome by an image forming apparatus comprising:

feeding means for feeding new paper, image forming means for forming an image on the paper fed by the feeding means, intermediate containing means for temporarily accommodating the paper fed by the feeding means and having the image formed thereon, refeeding means for refeeding the accommodated paper from the intermediate containing means to form an image on the paper again, detecting means for detecting presence or absence of paper to be fed by the refeeding means for image formation, and control means for effecting a change-over from the paper feeding operation by the refeeding means to the paper feeding operation by the feeding means upon the detecting means detecting the absence of paper to be refed.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Embodiments of the invention will be described below.

(1) Construction of Copying Machine

The construction of a copying machine embodying the invention will be described first.

Figure 1:
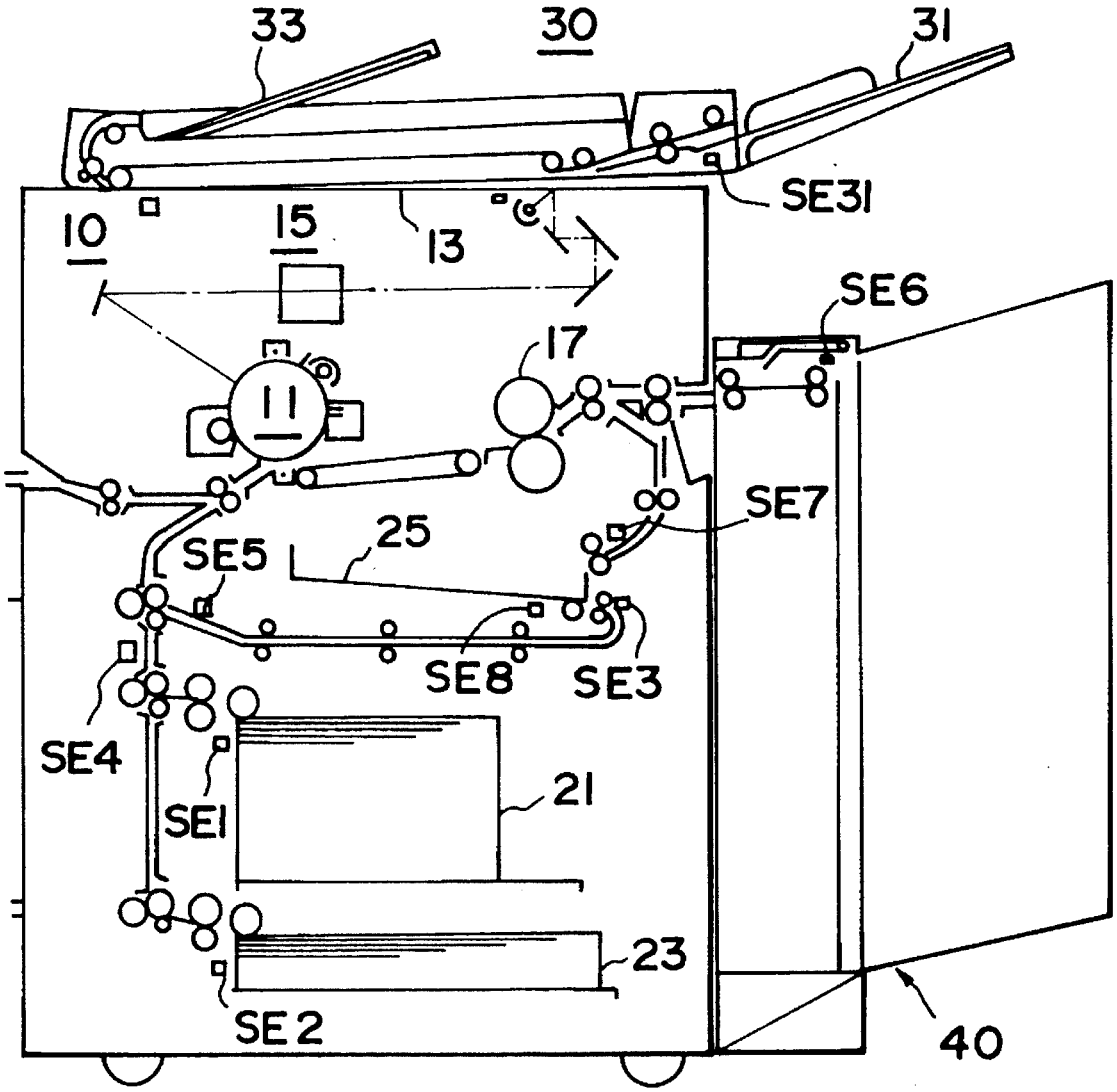
FIG. 1 is a front view in section schematically showing the overall construction of a copying machine embodying the invention.
Figure 2:
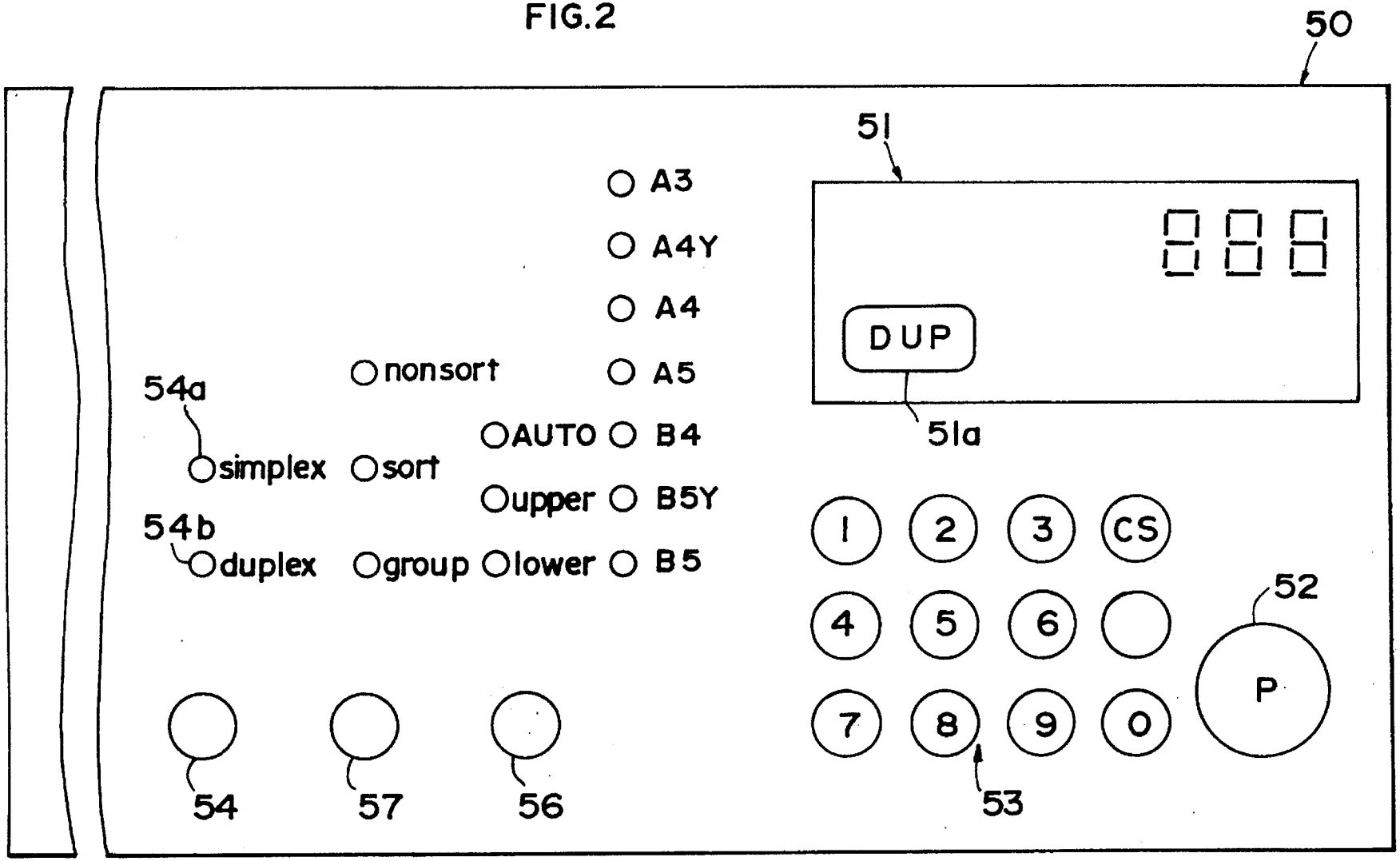
FIG. 2 is a fragmentary plan view showing an operation panel.
Figure 3:
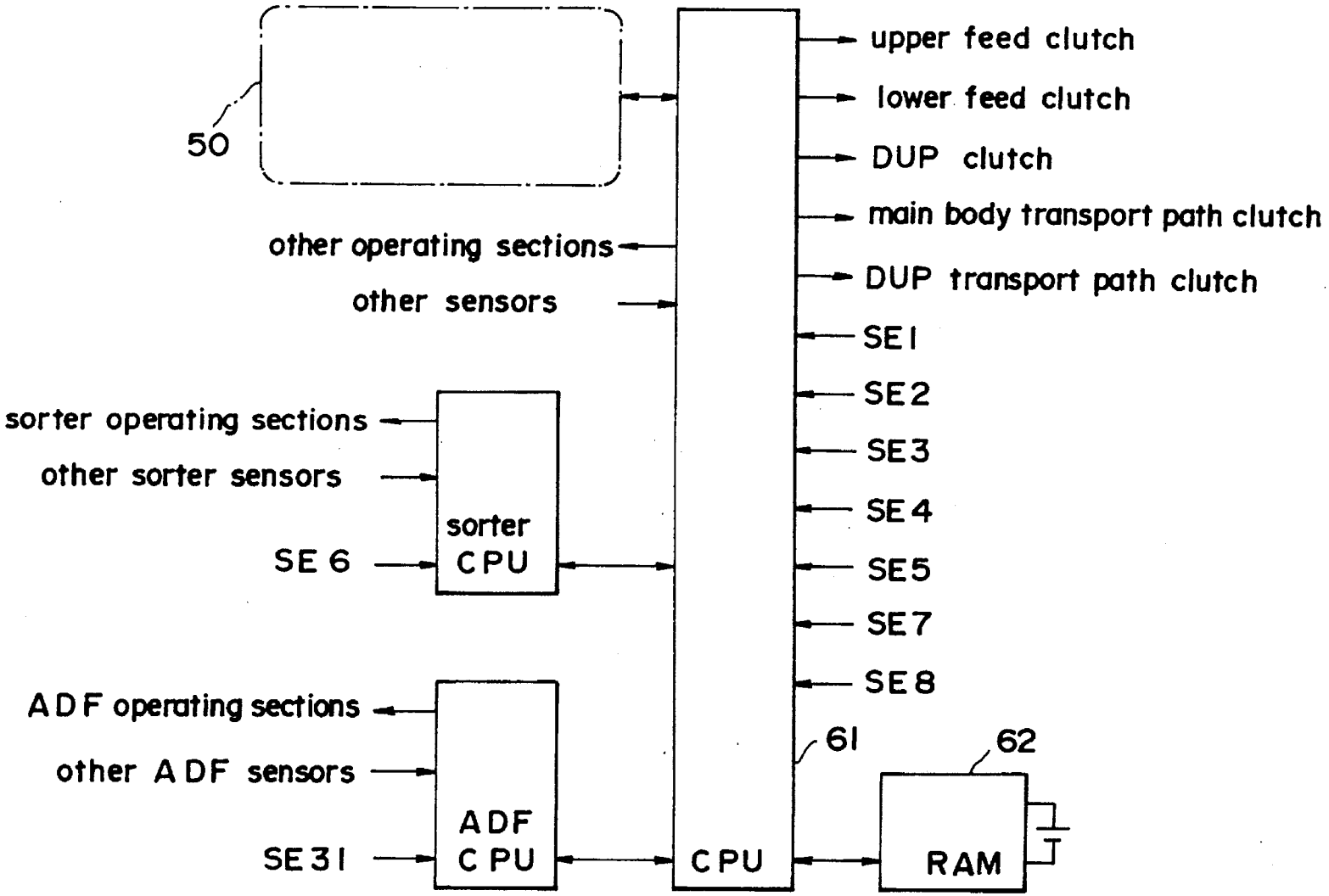
FIG. 3 is a block diagram showing the input-output relationship between signals of a CPU for controlling the copying machine.

FIG. 1 shows the construction of the copying machine, and FIG. 2 shows the operation panel of the copying machine. Further FIG. 3 shows the signals to be input to and output from a CPU for controlling the copying machine.

The illustrated copying machine comprises a copying machine main body 10, an automatic document feeder (ADF) 30 provided on a documents table glass plate of the main body 10, and a sorter 40 provided on the paper discharge side of the main body 10. As shown in FIG. 3, these components are controlled as related to one another.

The machine main body 10 is an apparatus for electrophotographically forming images. More specifically, a document set on the glass plate 13 is exposed to and scanned with light by a scanning optical system 15. This causes the light reflected from the document in the form of a slit to form an image on a charged surface of a photosensitive drum 11, forming on the charged surface a charge latent image corresponding to the reflected light. The latent image is developed with a toner into a visible image, which is then transferred onto paper. The transferred image on the paper is transported to a fixing device 17, by which the image is thermally fixed to the paper under pressure.

The paper is initially fed from the main body side. When to be fed again, the paper is refed from a duplex (DUP, refeeding) side.

In the case of feeding from the main body side, a sheet of paper is separately delivered by a feed roller from a feed outlet of an upper paper tray 21 or from a feed outlet of a lower paper tray 23 onto an initial transport path (main body transport path) and thereafter reaches an image forming station (where the toner image is transferred from the drum 11 onto the paper) via a common transport path.

The paper fed from the feed outlet (initial feed outlet) of the upper paper tray 21 is detected by a sensor SE1 disposed at this outlet. The paper fed from the e feed outlet (initial feed outlet) of the lower paper tray 23 is detected by a sensor SE2 provided at the outlet. The paper on the initial feeding transport path is detected by a sensor SE4 disposed at a position immediately before this path is joined to the common transport path. The detection signals from the sensors SE1, SE2, SE4 are input to a copying machine CPU 61 as shown in FIG. 3.

In the case of feeding from the duplex side, a sheet of paper is separately delivered by a feed roller from a refeed outlet of an intermediate tray 25 onto a refeeding transport path (DUP transport path) and then reaches the image forming station via the common transport path. The paper fed from the refeed outlet of the intermediate tray 25 is detected by a sensor SE3 disposed at the refeed outlet. The paper on the refeeding transport path is detected by a sensor SE5 disposed at a position immediately before this path is joined to the common transport path. The detection signals from the sensors SE3, SE5 are input to the CPU 61 as seen in FIG. 3.

The paper having the toner image fixed thereto by the fixing device 17 is sent to the sorter 40 or accommodated in the intermediate tray 25.

Stated more specifically, the paper fed from the initial feed outlet in a simplex mode (mode in which only one surface of paper is used for copying) is sent to the sorter 40. The paper fed from the refeed outlet in a duplex mode (mode in which both surfaces of paper are used for copying) is sent also to the sorter 40. The delivery of the paper to the sorter 40 is detected by a sensor SE6 disposed immediately before a discharge opening of the sorter 40. The detection signal of the sensor SE6 is input to a CPU of the sorter and thereafter to the copying machine CPU 61 as shown in FIG. 3.

The paper fed from the initial feed outlet in the duplex mode is accommodated in the intermediate tray 25. The accommodation of paper in the tray 25 is detected by a sensor SE7 disposed at a position immediately before an inlet of the tray 25. Presence of paper in the intermediate tray 25 is detected by a sensor SE8 disposed immediately below the tray 25. The detection signals of the sensors SE7, SE8 are fed to the CPU 61 as seen in FIG. 3. The intermediate tray 25 is so constructed as to receive the paper from the upper side and feed the paper from the lowermost position.

FIG. 2 shows an operation panel 50 which is provided at the front side of the top portion of the copying machine main body 10. The operation panel 50 is provided with a display panel 51 for showing various messages or the number of copies to be made, etc., copy start commanding print key 52, number entry key unit 53, copy mode key 54 for selecting the simplex mode or duplex mode, simplex mode indicator 54*a* which is turned on to show the simplex mode as selected, duplex mode indicator 54*b* which is turned on to show the duplex mode as selected, feed outlet selection key 56 for the selection of lower/upper/auto, sort mode key 57 for the selection of nonsort/sort/group, etc. The display panel 51 includes a DUP display 51*a*, which is an alarm display for indicating that paper remains in the intermediate tray 25 in the event of a jam.

The automatic document feeder (ADF) 30 is a device for successively delivering documents set in a document tray 31 in accordance with a command from the copying machine CPU 61, stopping each document in position on the document table glass plate 13 for scanning and discharging the document onto a discharge tray 33 after the completion of scanning. The document as set in the document tray 31 is detected by a sensor SE31 disposed at a feed outlet of the tray 31, and the detection signal is input to a CPU of the ADF and then to the copying machine CPU 61 as shown in FIG. 3.

The sorter 40 is a device for assorting sheets of paper discharged from the copying machine main body 10 as arranged on a plurality of bins 41 in accordance with a specified mode. More specifically, in a sort mode, copies of the same document are assorted on different bins 41 to obtain a predetermined number of copies. In a group mode, each group of copies of the same document is discharged onto one of the bins 41. Further in a nonsort mode, all copies are discharged onto the uppermost bin 41 without sorting.

(2) Control of Copying Machine

Control of the copying machine in connection with paper transport will be described next with reference to the flow charts showing the process to be executed by the CPU 61.

Figure 4:
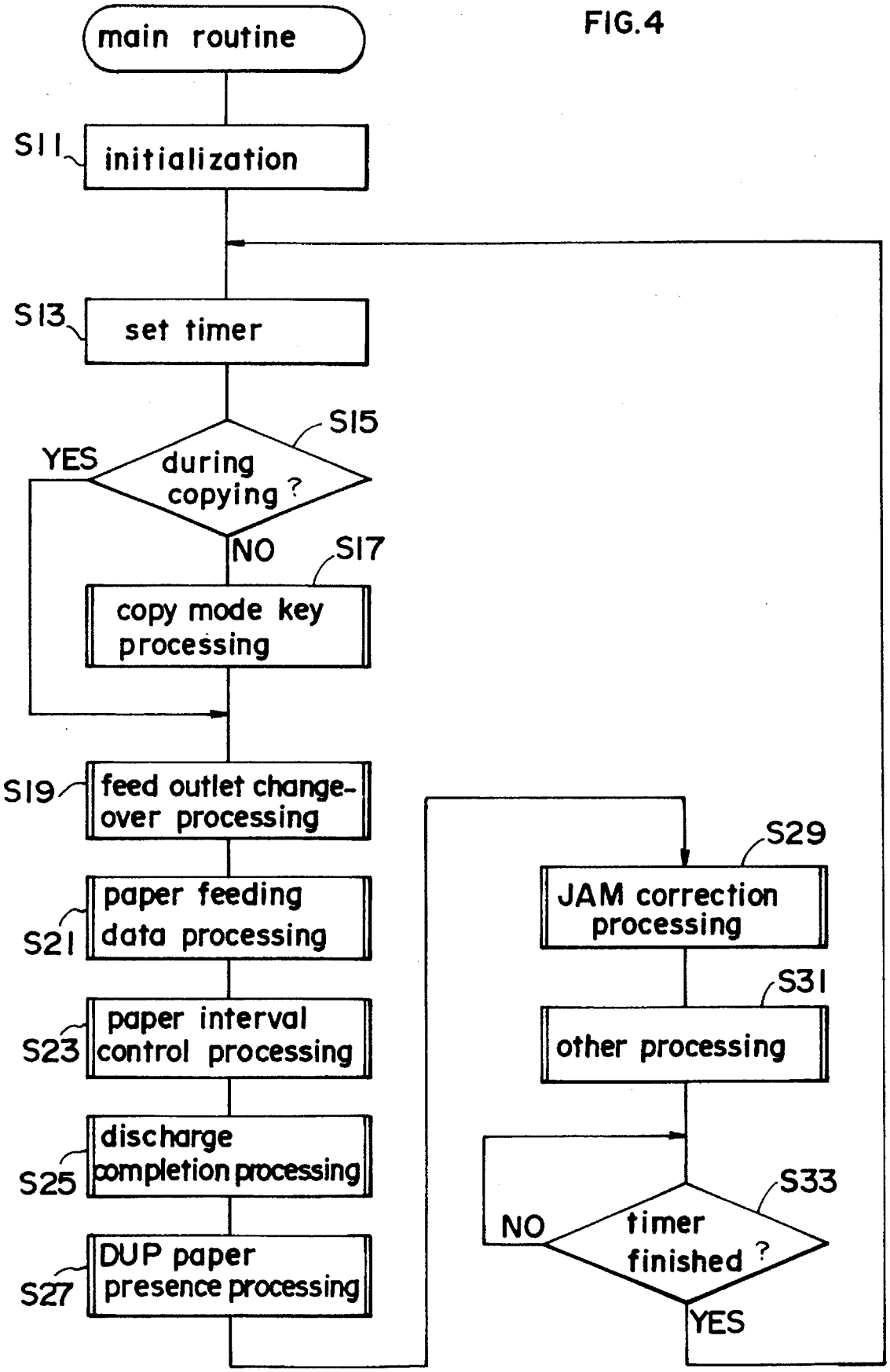
FIG. 4 is a flow chart showing the main routine of the process to be executed by the CPU.

(2-1) Main Routine (FIG. 4)

The process is initiated, for example, by turning on-the power supply, followed first by step S11 for initialization and then by repetitions of steps S17 to S31 at a time interval determined by step S13 (S33).

Generally, the following processing is effected in steps S17 to S31.

*Copy Mode Key Processing (S17)

Every time an input is given by pressing the copy mode key 54, the mode is changed over like . . . →simplex copy mode→duplex copy mode→simplexy copy mode . . .

*Feed Outlet Change-Over Processing (S19)

Upon the number of paper sheets fed from the main body side reaching the specified number, the feed outlet setting is changed over to the duplex side (DUP side) to execute processing for the initiation of paper feeding operation from the duplex side. Further when the DUP tray (intermediate tray) 25 has been emptied of paper, the feed outlet setting is changed over to the main body side to effect processing for the start of paper feeding operation from the main body side.

*Paper Feeding Data Processing (S21)

Every time a paper sheet is fed, data identifying the particular feed outlet concerned (main body side or DUP side) and data indicating effectiveness (these items of data will hereinafter be referred to as "paper data") are stored in the newest area in a memory. Further the paper data stored in the memory in the past is shifted item by item to an older area.

Further if the sheet fed is from the main body side, a feed counter 1 and a feed counter 2 are incremented until the number of sheets fed reaches the specified number. Alternatively if the sheet fed is from the DUP side, a DUP feed counter is incremented.

*Paper Interval Control (S23)

When the number of sheets passed through the main body transport path has become equal to the number of sheets fed from the main body side, transport via the main body transport path is inhibited, while transport through the DUP transport path is permitted, and processing to resume the transport via this path is executed.

When the number of sheets passed through the DUP transport path has become equal to the number of sheets fed from the DUP side, transport via the DUP transport path is inhibited, transport through the main body path is permitted, and processing to resume the transport via this path is executed.

Further when paper is detected at a specified position along the inhibited transport path (position immediately before the junction of the main body path and the DUP path), the transport operation is discontinued.

*Discharge Completion Processing (S25)

Every time a paper sheet is discharged from the machine, the oldest of the items of effective paper data as to the sheets fed from the DUP feed outlet is nullified.

Further every time a sheet is placed into the DUP tray 25, the feed counter 2 is decremented, and the oldest of the items of effective paper as to the sheets fed from the main body feed outlet is nullified.

*DUP Paper Presence Processing (S27)

Depending on the presence or absence of paper in the DUP tray 25, a DUP presence flag is made "1" or "0".

* Jam Correction Processing (S29)

When jam resetting is effected with a duplex print remaining within the machine before being discharged therefrom and with a simplex print present in the DUP tray 25, an alarm is given to this effect, and usual jam correction processing (processing for indicating the specified number of copies and the number of return documents) is thereafter executed. Furthermore, all paper data is reset.

*Other Processing (S31)

The process except for the foregoing processing procedures is collectively shown as a step. For example, a sequence of copying operations is controlled.

Figure 5:
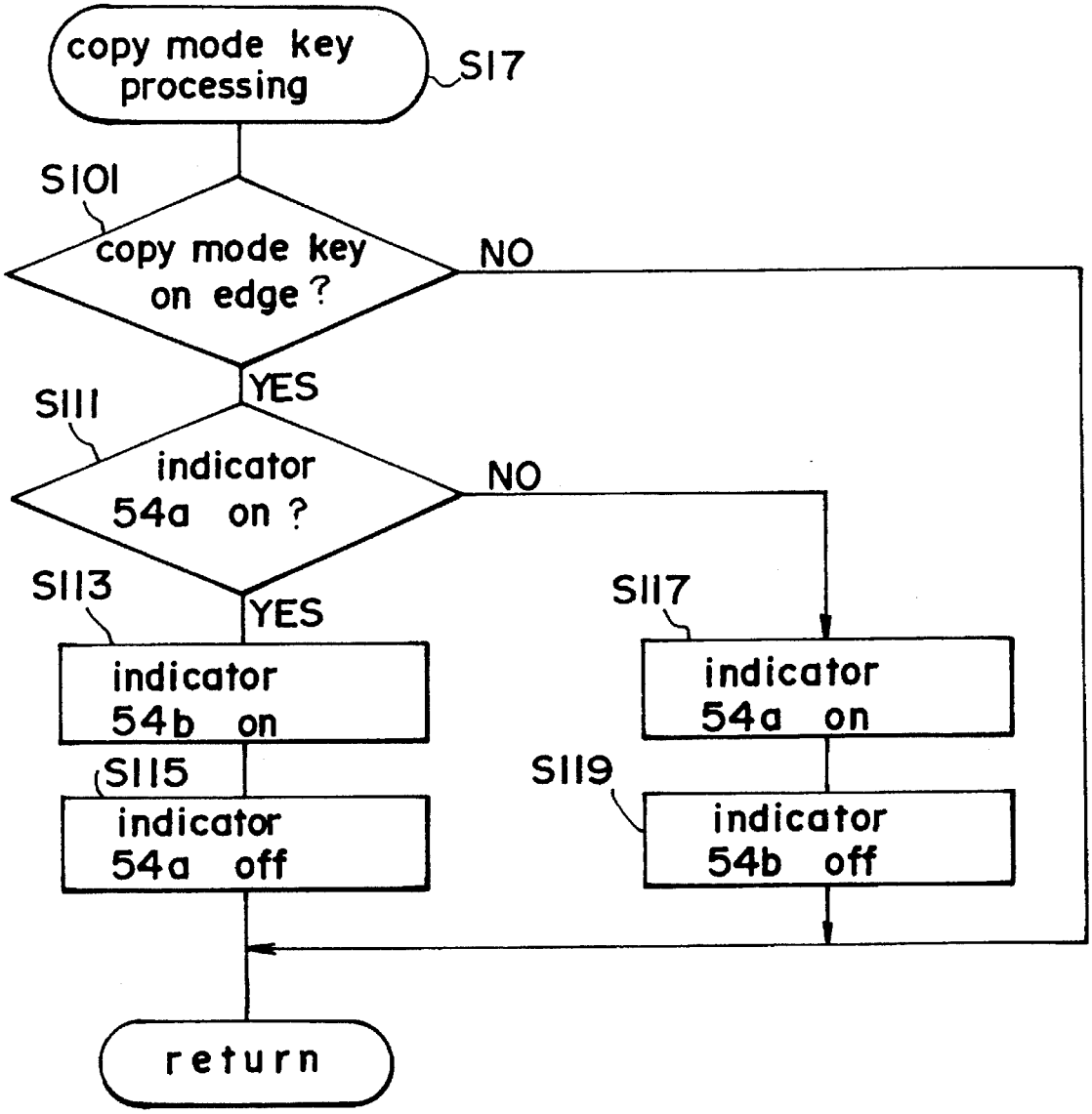
FIG. 5 is a flow chart showing a copy mode key processing subroutine.

(2-2) Copy Mode Key Processing (FIG. 5)

When the copy mode key 54 is found to be on edge (change in state from off state to on state, the same as hereinafter) (S101; YES), and when the machine is in the simplex copymode with the simplex copy mode indicator 54*a* on (S111; YES), the duplex copy mode is set, whereby the duplex mode indicator 54*b* is turned on (S113) and the dimplex mode indicator 54*a* is turned off (S115).

When the copy mode key 54 being on edge is detected (S101; YES) detected with the machine set in in the duplex copy mode and with the simplex mode indicator 54*a* off (S111; NO), the simplex copy mode is set. This turns on the simplex mode indicator 54*a* (S117) and turns off the duplex mode indicator 54*b* (S119).

Figure 6:
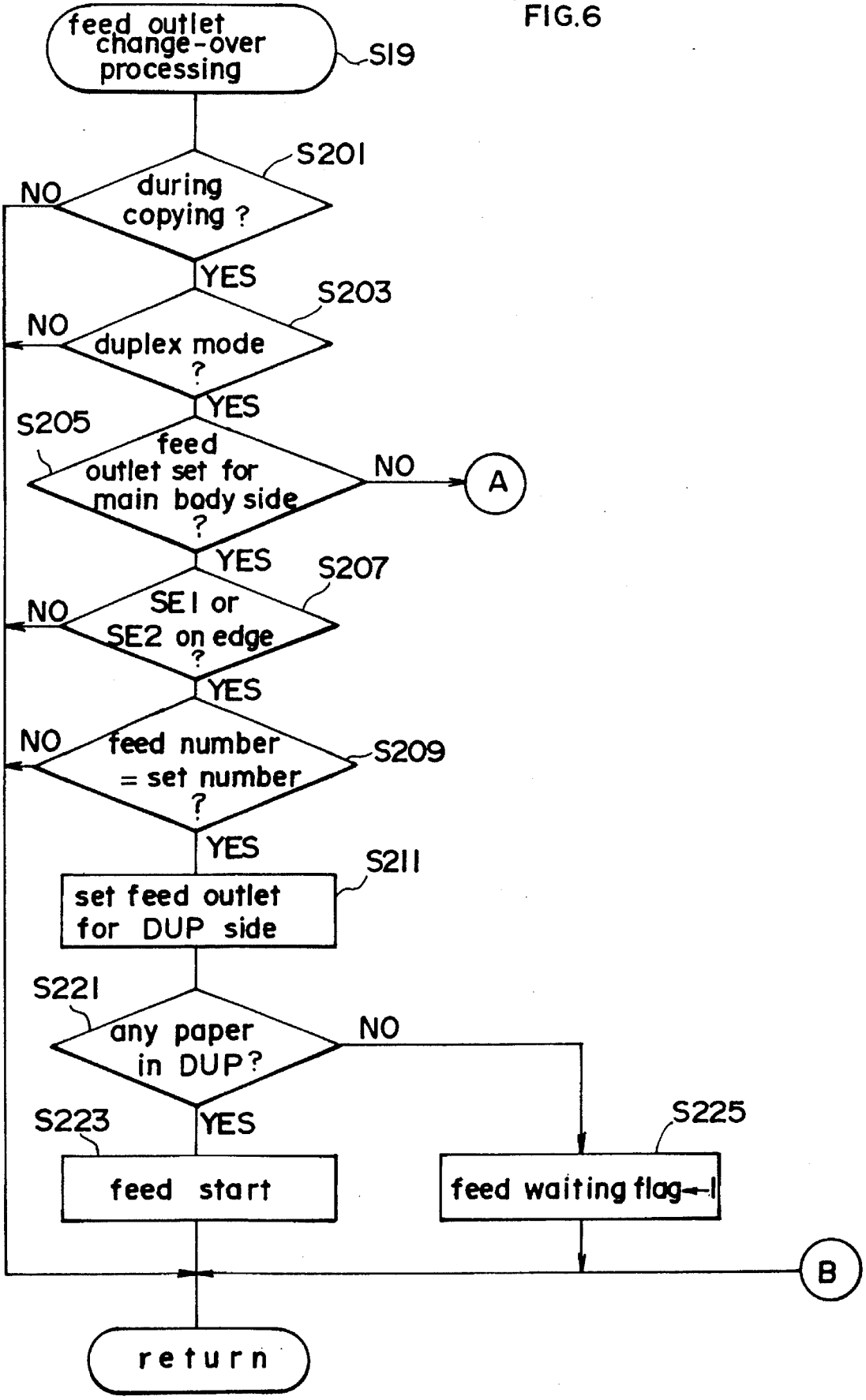
FIG. 6 is a flow chart showing a feed outlet change-over processing subroutine.
Figure 7:
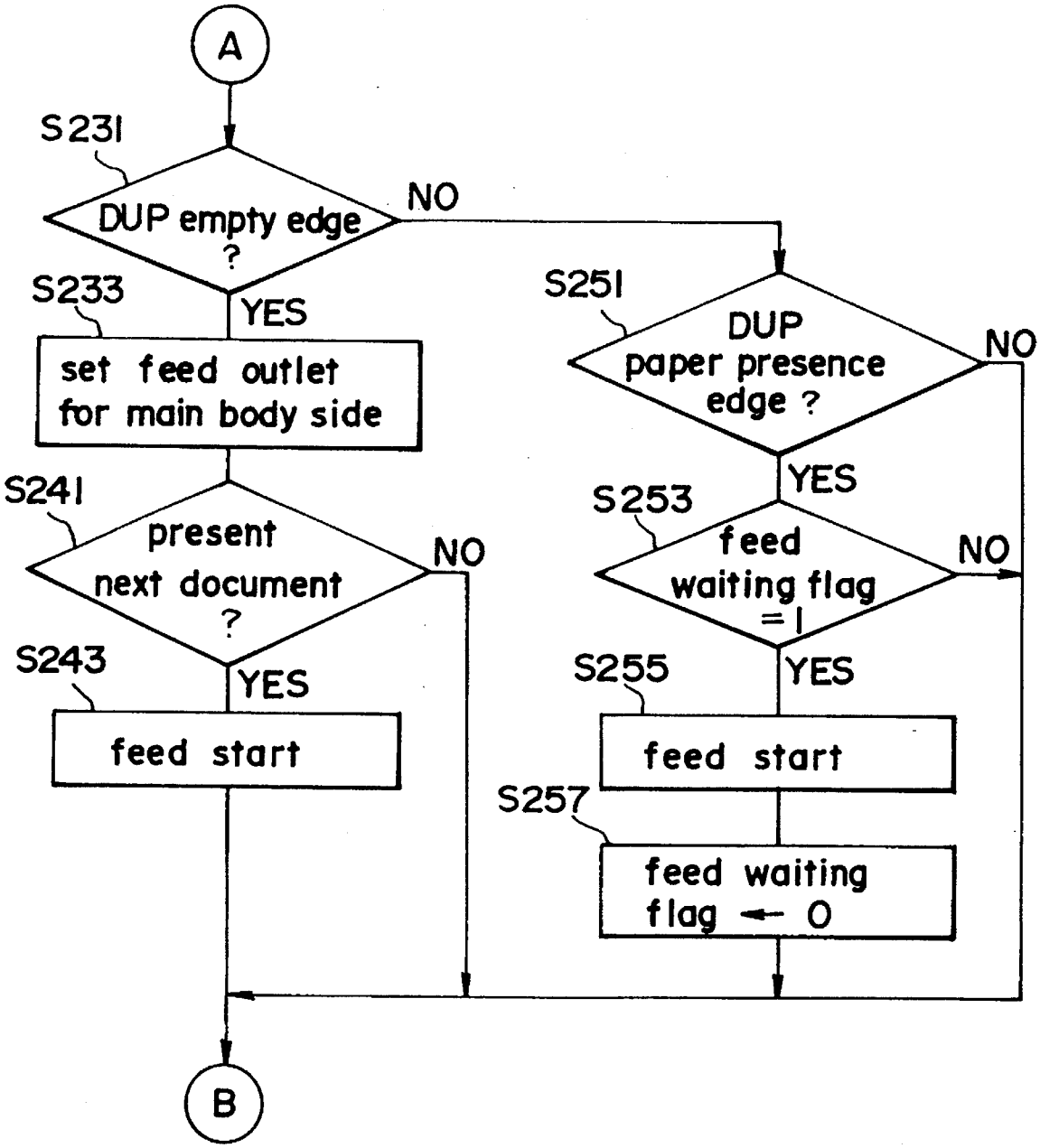
FIG. 7 is a flow chart showing the feed outlet change-over processing subroutine.

(2-3) Feed Outlet Change-Over Processing (FIGS. 6, 7)

This processing is effected while the machine is in copying operation (S201; YES).

First in the case where the machine is in the duplex copy mode (S203; YES) with the feed outlet set for the main body side (S205; YES), the sensor SE1 or SE2 for detecting the start of feeding of paper from the outlet on the main body side is found to be on edge (S207; YES), whereupon an inquiry is first made as to Whether the number of sheets so far fed has reached the specified number of copies set. If the answer is affirmative (S209; YES), the feed outlet is alternatively set for the DUP side (refeeding side) (S211). Further when paper is present in the DUP tray 25 (S221; YES), feeding is immediately started from the DUP feed outlet (S223). Alternatively when no paper is present in the DUP tray 25 at this time (S221; NO), a feed waiting flag is set to "1" (S225) so as to immediately initiate feeding (refeeding) upon accommodation of paper in the DUP tray.

Thus, in steps S203 through S225, the feed outlet setting is changed over from the main body side to the DUP side when the last sheet (corresponding to the copy number setting in order) has been fed from the main body feed outlet. Paper feeding from the DUP feed outlet is further started, or the system waits for the start of feeding operation from the DUP feed outlet.

In the case where the feed outlet set not for the main body side but for the DUP side (S205; NO) in the duplex copy mode (S203; YES), the feed outlet setting is changed over from the DUP side to the main body side (S233) when absence of paper in the DUP tray 25 is detected (S231; YES). When the next document is present on the ADF 30 (S241; YES), feeding operation from the main body feed outlet is initiated (S243).

Thus in steps S231 to S243, the feed outlet setting is changed over from the DUP side to the main body side when the last sheet (last sheet in the DUP tray 25) has been fed from the DUP feed outlet. Feeding operation from the main body feed outlet is further started on condition that the nex document is present.

Figure 8:
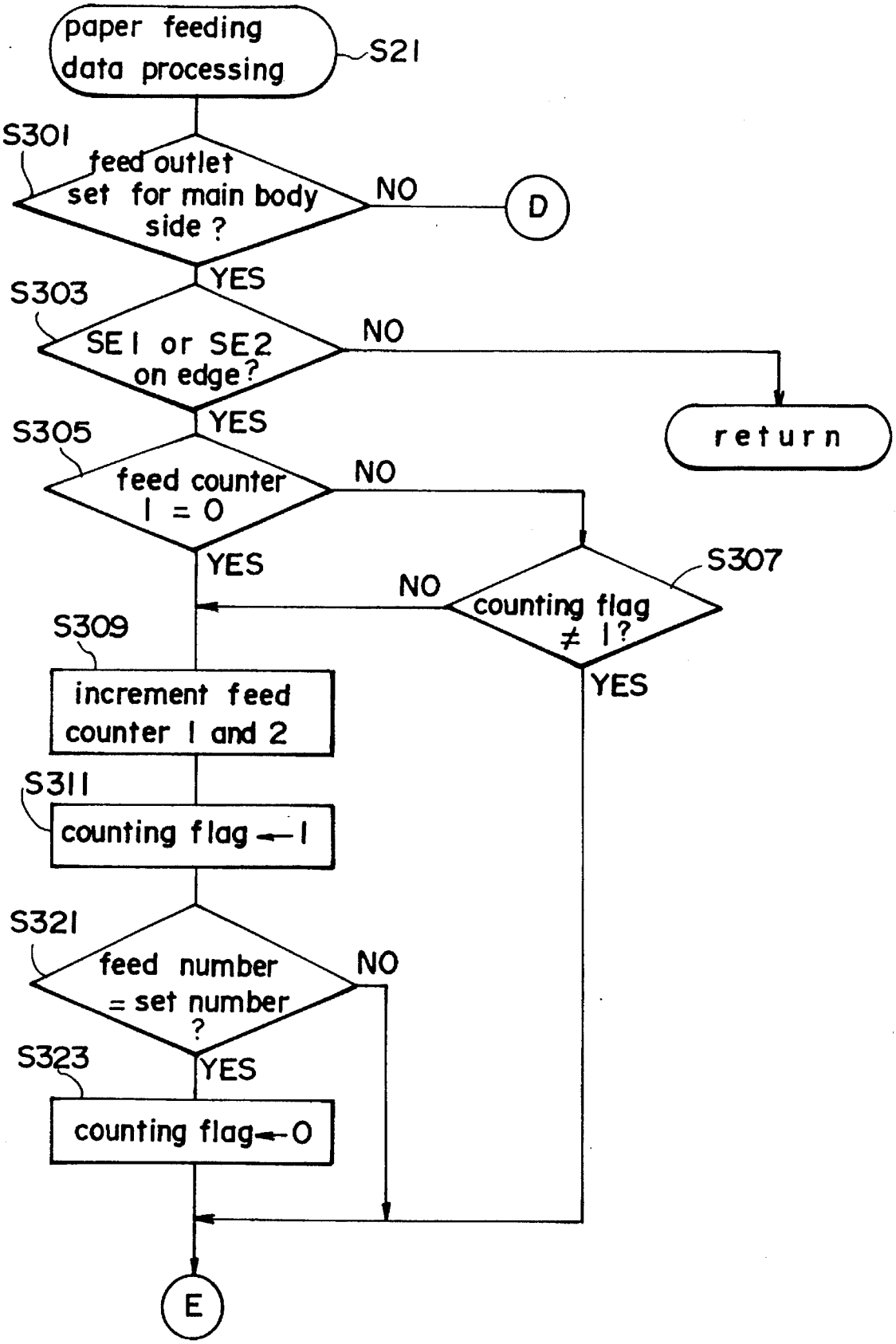
FIG. 8 is a flow chart showing a paper feeding data processing subroutine.
Figure 9:
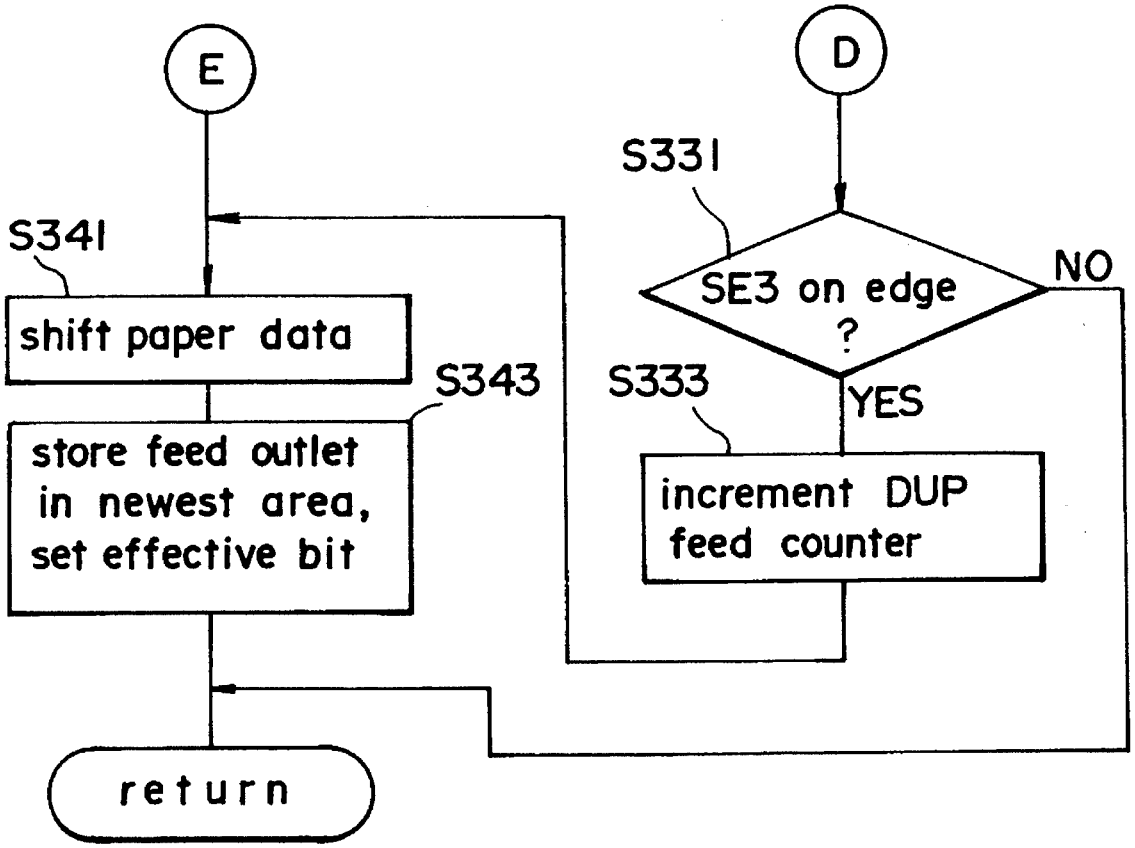
FIG. 9 is a flow chart showing the paper feeding data processing subroutine.

When the sensor SE8 is found to become on edge(S251; YES) upon accommodation of paper in the DUP tray 25, with the feed waiting flag set to "1" (S253; YES, see S225), feeding from the DUP feed outlet is started (S255). The feed waiting flag is thereafter reset to "0" (S257). (204) Paper Feeding Data Processing (FIGS. 8, 9)

In the case where the feed outlet is set for the main body side (S301; YES), the sensor SE1 or SE2 for detecting the start of feeding from the main body feed outlet is found to be on edge (S303; YES), whereupon the feed counters 1, 2 are incremented (S309) on condition that the feed counter is "0" (S305; YES) or that a counting flag is "1" (S307; NO). After the increment, the counting flag is set to "1" (S311).

The counting flag is a flag which is reset to "0" (S323) upon the number of fed sheets from the main body side reaching the copy number setting (S321; YES). Accordingly, the feed counters 1, 2 are incremented (S309) as stated above when each of the specified number of sheets, from the first to the last, starts a feeding movement from the main body outlet.

Figure 18:
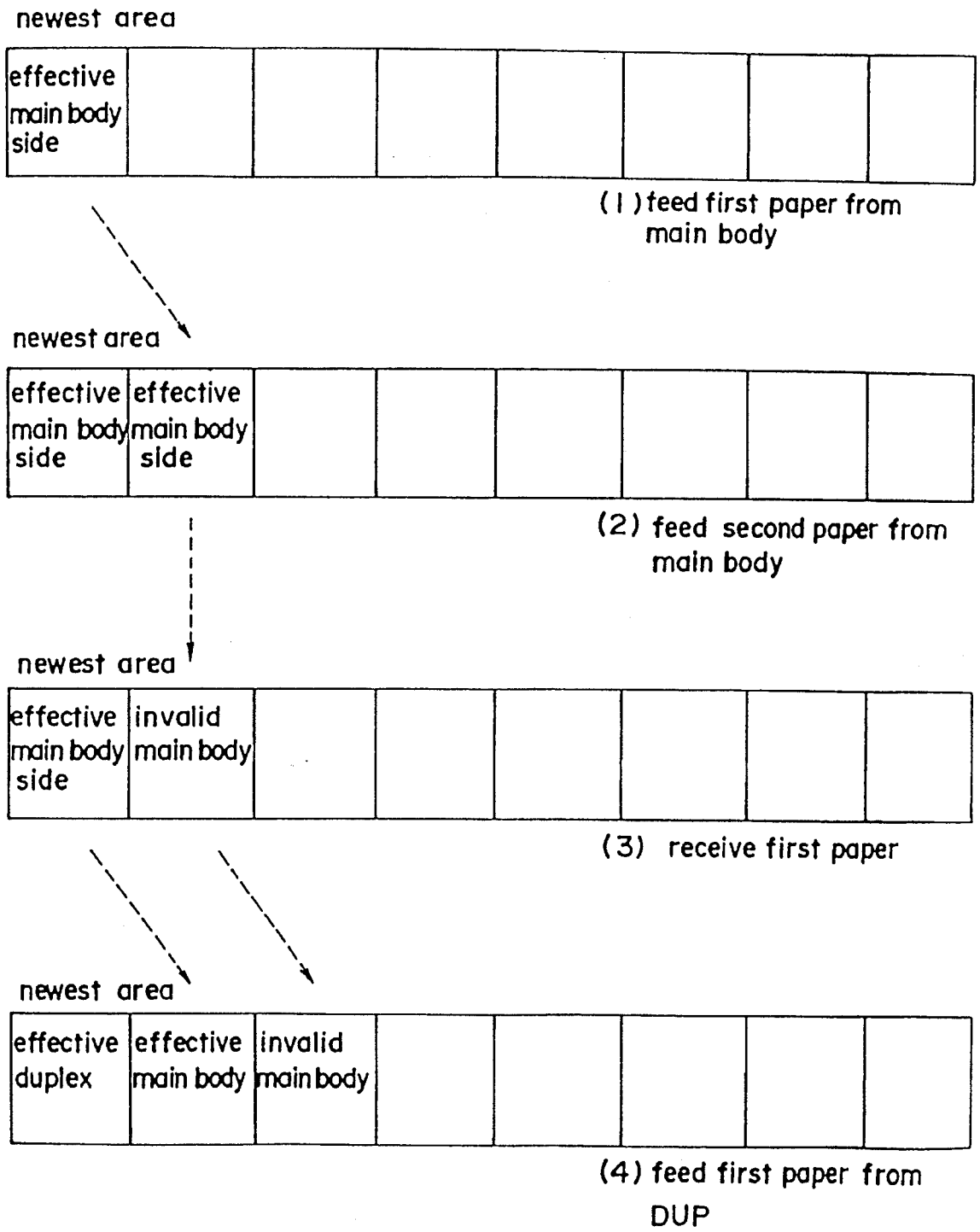
FIG. 18 is a diagram for illustrating storage of paper data in a memory and shift thereof.

After steps S301 to S323, the paper data (data as to main body feed outlet/DUP feed outlet, and data as to effectiveness/null) in the past and stored in the memory is shifted item by item to an older area as shown in FIG. 18 (S341). Further the current feed outlet (main feed outlet in the case of steps S301 to S323) is stored in the newest area in the memory, and an effective bit is set (S343). FIG. 18 shows a case wherein the specified number of copies set is 2.

Further in the case where the feed outlet is set not for the main body side but for the DUP side (S301; NO), the sensor SE3 for detecting the start of feeding from the DUP feed outlet becoming on is detected (S331; YES), whereupon the DUP feed counter is incremented (S333), followed by steps S341 to-S343. More specifically, the past paper data in the memory is shifted item by item to an older area in the memory (S341), and the current feed outlet (DUP feed outlet in the case of steps S331 to S333) and an effective bit is set in the newest area (S343).

Thus in the paper feeding data processing, the feed counter corresponding to the feed outlet concerned is incremented, and paper data is shifted or stored.

Figure 10:
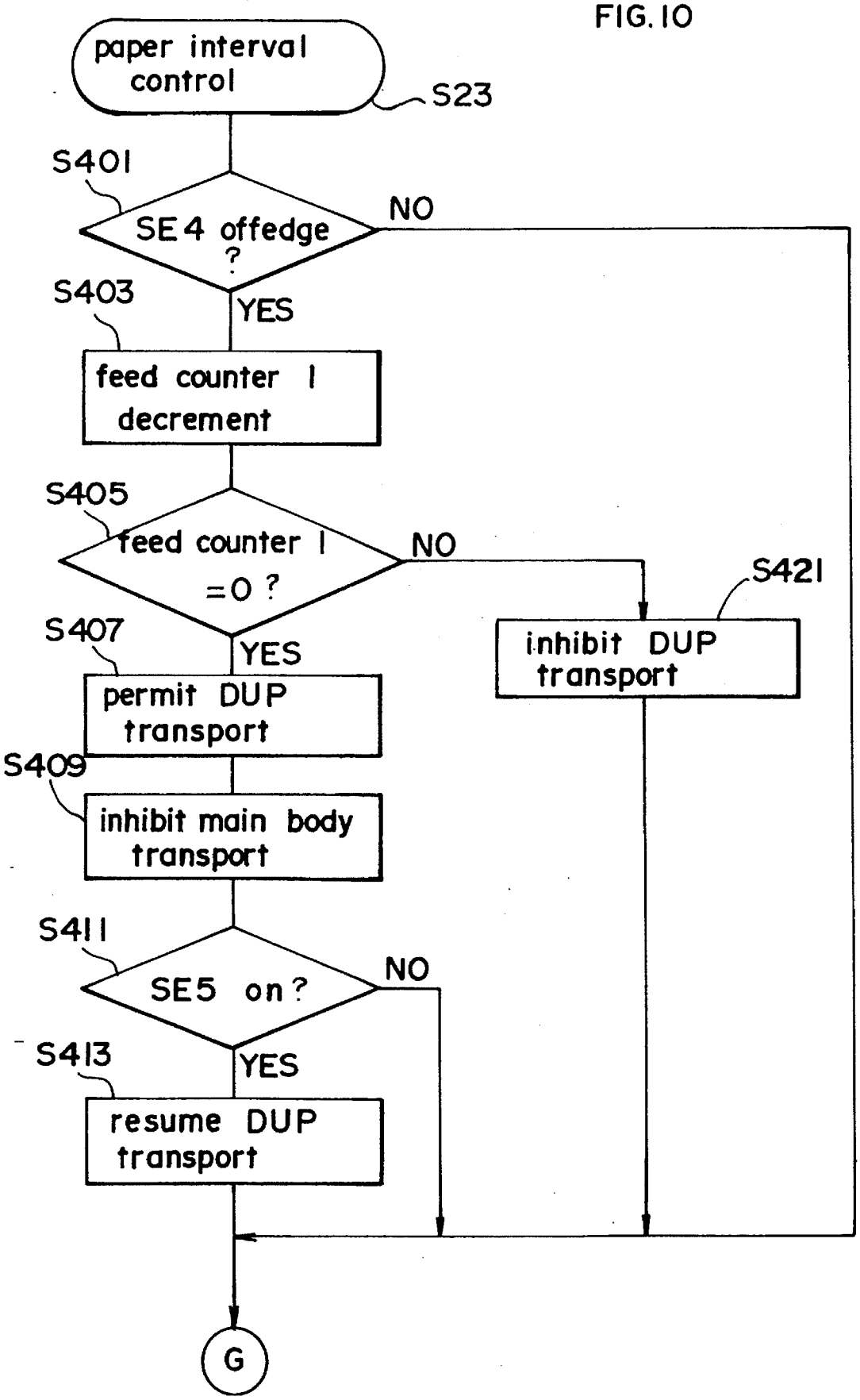
FIG. 10 is a flow chart showing a paper interval control subroutine.
Figure 11:
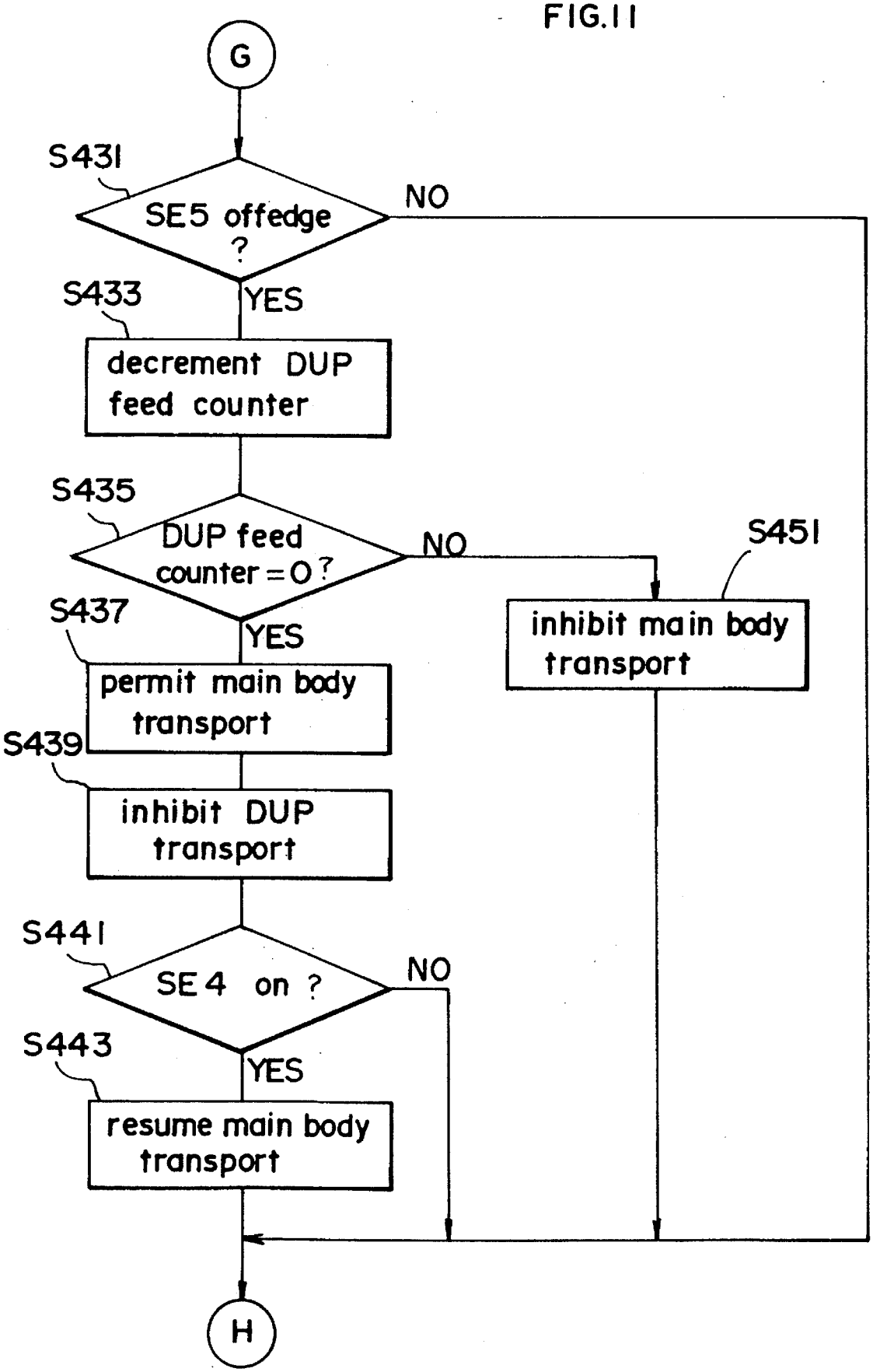
FIG. 11 is a flow chart showing the paper interval control subroutine.
Figure 12:
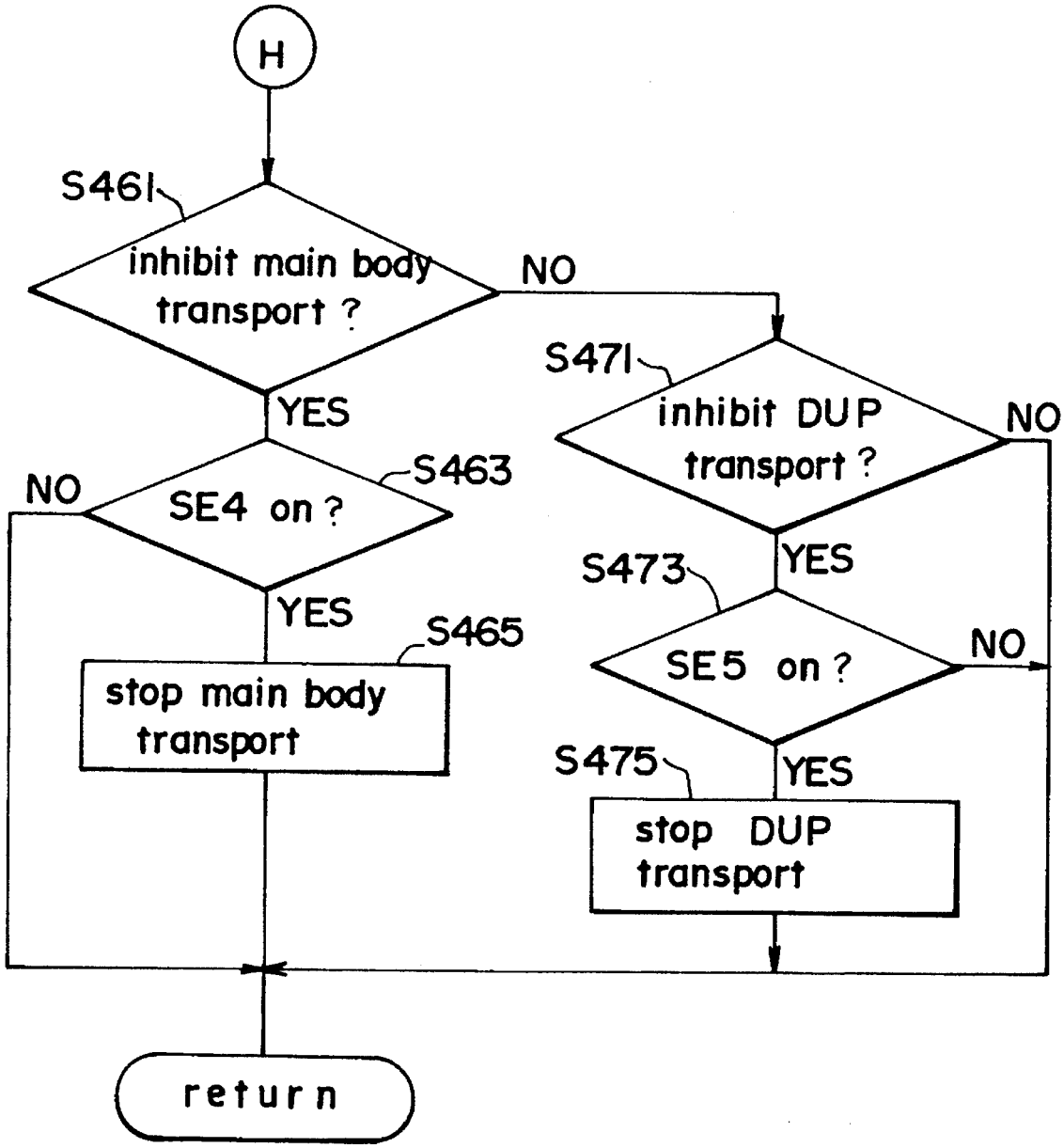
FIG. 12 is a flow chart showing the paper interval control subroutine.

(2-5) Paper Interval Control (FIGS. 10–12)

Every time the sensor SE4 for detecting the passage of paper through the main body transport path becoming off edge (change in state from on state to off state, the same as hereinafter) is detected (S401; YES), the feed counter 1 is decremented (S403).

Figure 20:
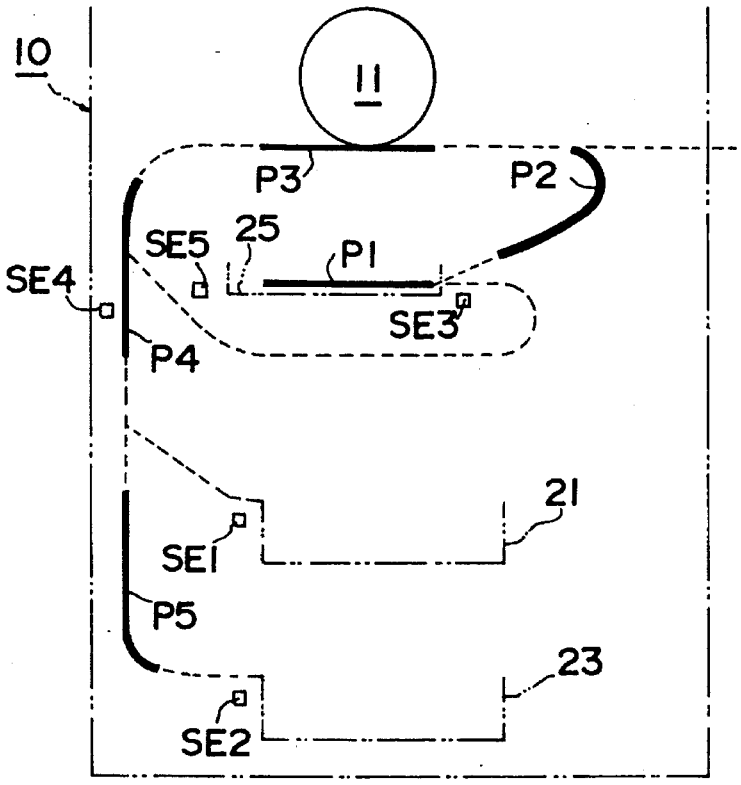
FIG. 20 is a diagram for illustrating sheets of paper being transported inside the copying-machine.
Figure 21:
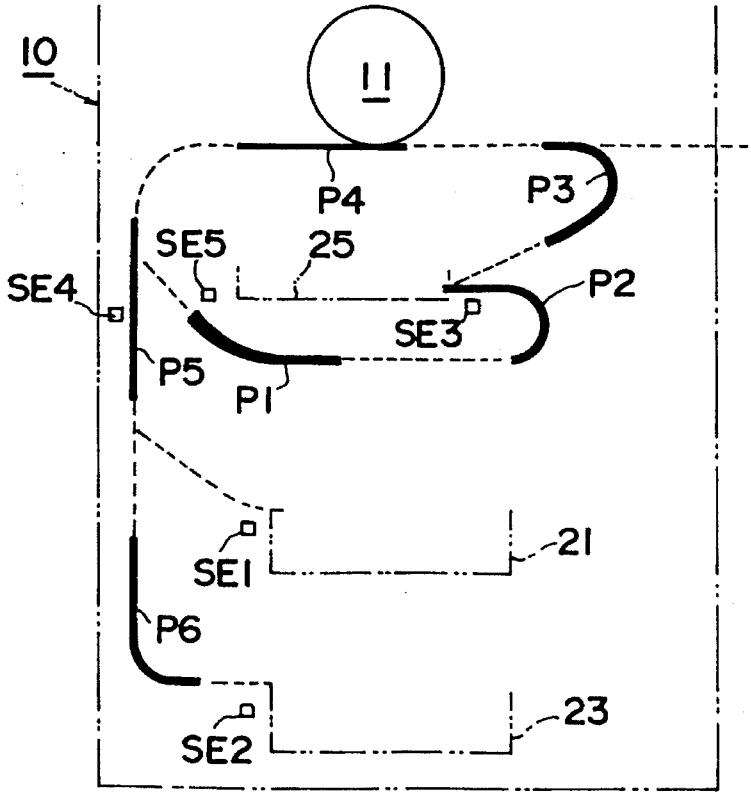
FIG. 21 is a diagram for illustrating sheets of paper being transported inside the machine.

While the feed counter 1 is not "0", in other words, while paper is being transported on the main body transport path (S405; NO), transport of paper on the DUP transport path is inhibited (S421), and paper, if present on the DUP transport path, is halted at the position of the sensor SE5 (S475). For example with reference to FIG. 20, the fourth sheet P4 (copy number setting in the illustrated case: 6) is being transported on the main body transport path, so that the DUP transport path is held out of transport operation. Further with reference to FIG. 21 wherein the fifth sheet P5 is being transported on the main body transport path, the DUP transport path is held out of transport operation, with the result that the sheet Pi sent forward on the DUP transport path is halted at the position of the sensor SE5.

Figure 22:
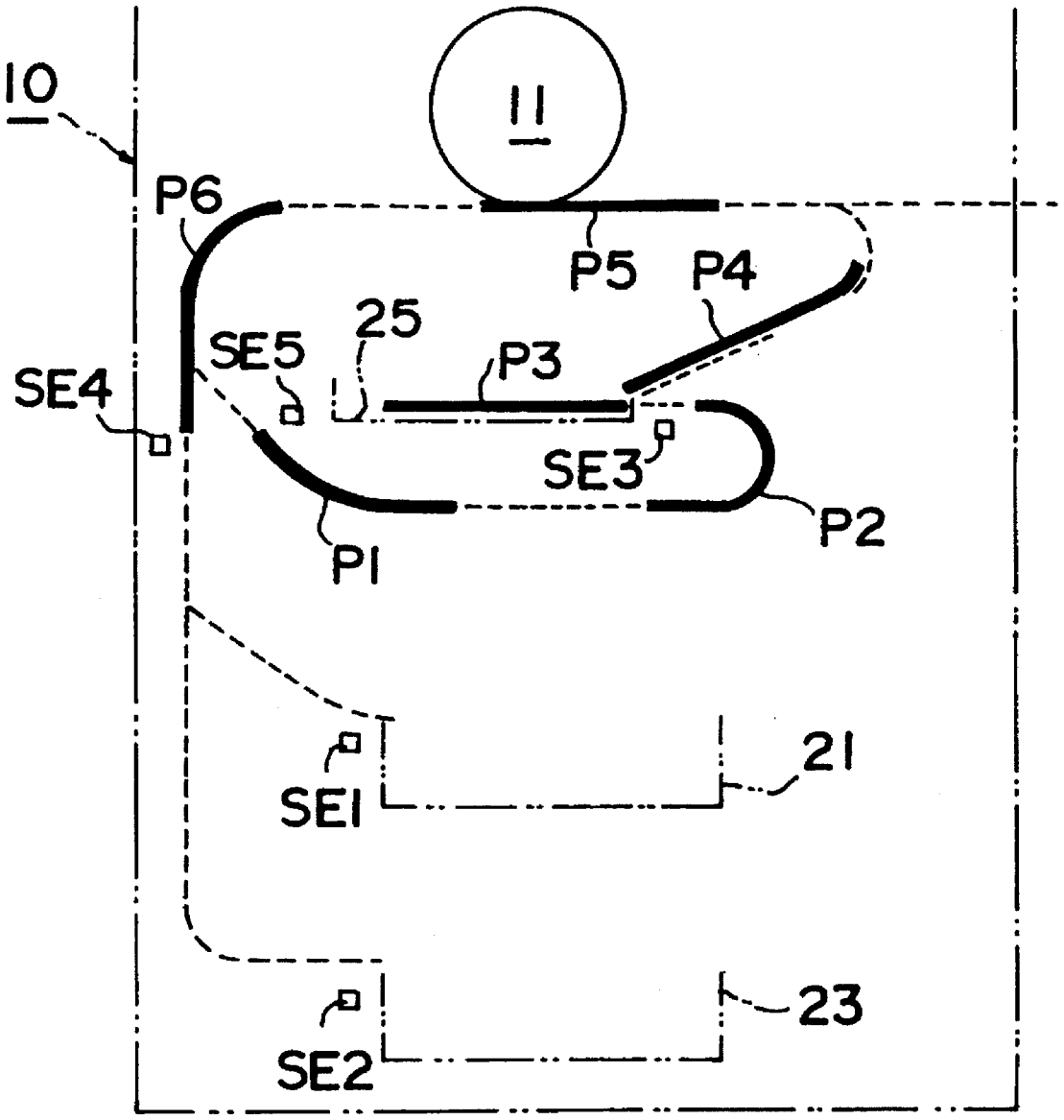
FIG. 22 is a diagram for illustrating the sheets of paper being transported inside the machine.

When the feed counter 1 is reset to "0" owing to the decrement (S405; YES), permission is given for the transport of paper on the DUP transport path (S407), and the transport of paper on the main body path is inhibited (S409). Further when paper is present on the DUP transport path (S411; YES), transport of paper on this path is resumed (S413). For example with reference to FIG. 22, the sixth sheet P6 corresponding to the last of the prints to be made has been sent into the common transport path from the main body transport path, so that the DUP transport path is in condition for the transport of paper. Further with the sheet P1 detected by the sensor SE5 of the DUP transport path, transport of the sheet P1 is immediately resumed.

On the other hand, every time the sensor SE5 for detecting the passage of paper through the DUP transport path becoming off edge is detected (S431; YES), the DUP feed counter is decremented (S433). Further while the DUP feed counter is not "0", in other words, while paper is being transported on the DUP transport path (S435; NO), transport of paper on the main body transport path is inhibited (S451), and paper, if any on the main body transport path, is halted at the position of the sensor SE4 (S465).

Further when the DUP feed counter becomes "0" as the result of the decrement of this counter (S435, YES), permission is given for the transport of paper on the main body transport path (S437), and transport of paper on the DUP transport path is inhibited (S439). Further when paper is present on the main transport path (S441; YES), transport of paper on this path is resumed (S443).

Steps S461 and the following steps provide a process wherein while the main body transport path is inhibited from transporting paper (S461; YES) as in steps S409, S451, this path is held out of paper feeding operation (S465) when paper is present on the main body transport path (S463; YES), and further provide a process wherein while the DUP transport path is inhibited from transporting-paper(S471; YES) as in steps S421, S439, this path is held out of paper feeding operation (S475) when paper is present on the DUP transport path (S473; YES).

Figure 13:
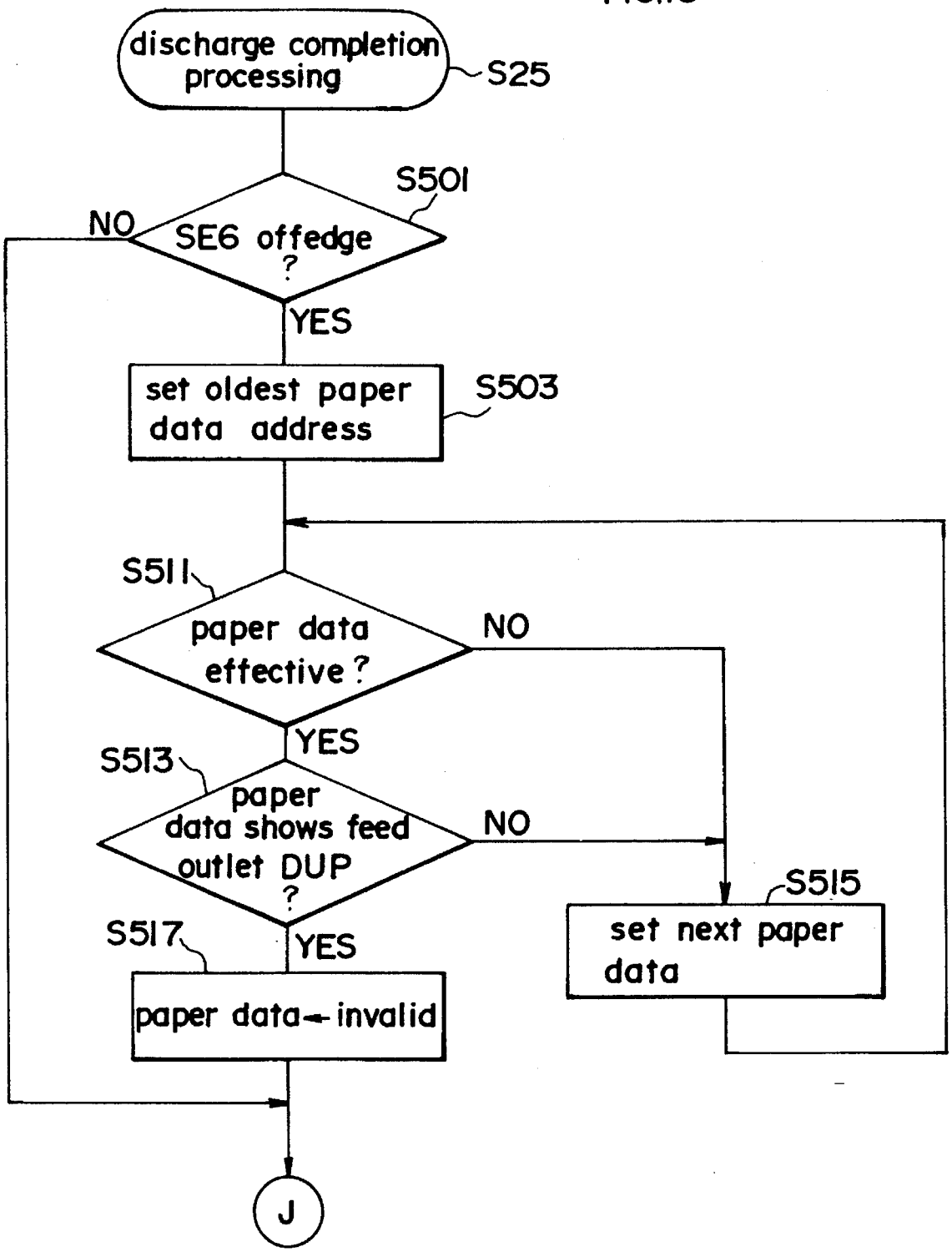
FIG. 13 is a flow chart showing a discharge completion processing subroutine.
Figure 14:
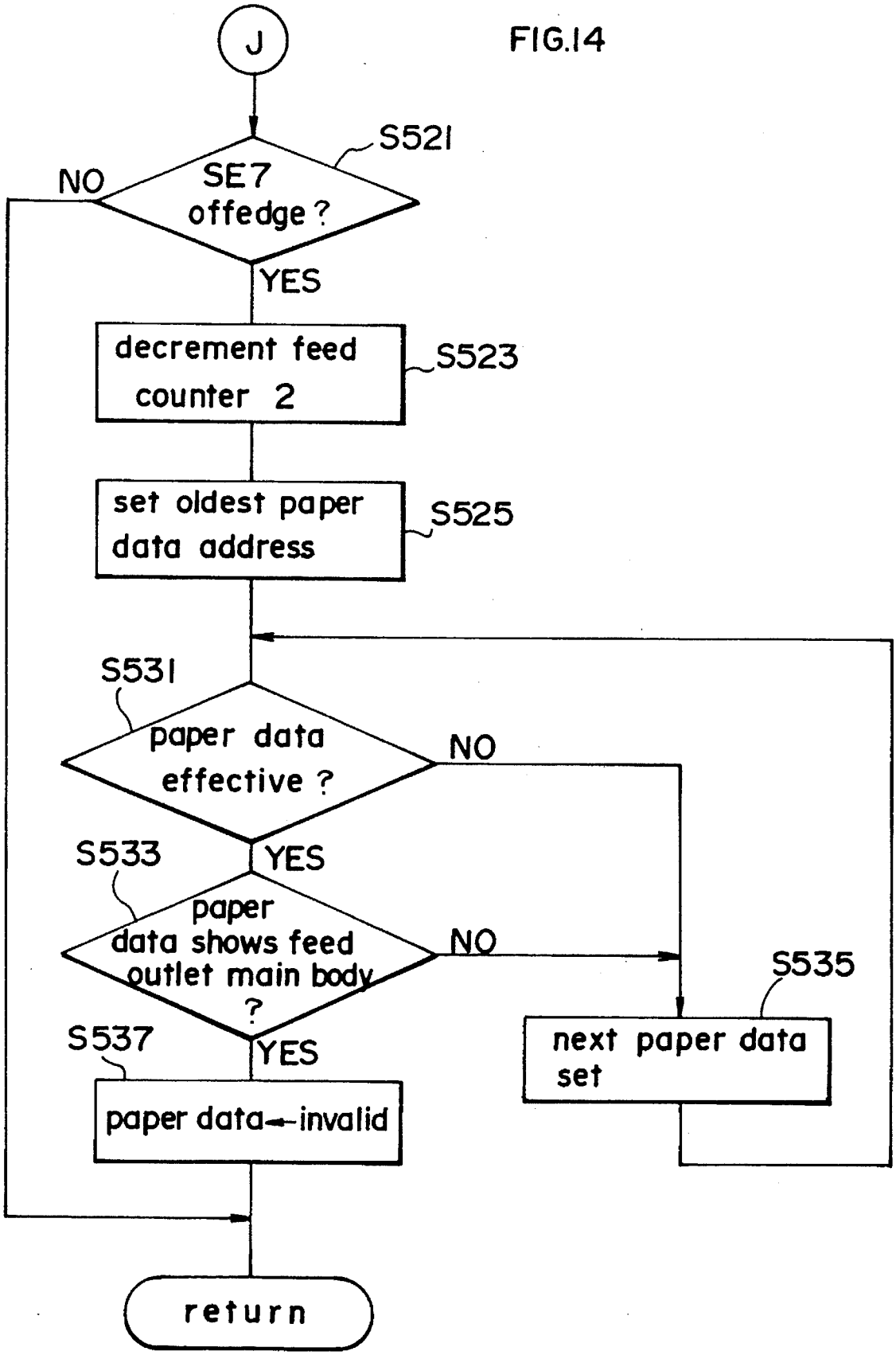
FIG. 14 is a flow chart showing the discharge completion processing subroutine.

(2-6) Discharge Completion Processing (FIGS. 13, 14)

When the sensor SE6 for detecting passage of paper on a path of discharge from the machine becoming off edge is detected (S501; YES), the oldest of the items of effective paper data as to the sheets fed from the DUP side is nullified.

Stated more specifically., the address of the oldest item of paper data is set (S503), and the data is checked for effectiveness (S511). Consequently, if it is null (S511; NO), or when it is paper data as to the paper fed from the main body side even if effective (S513; NO), the address of the second oldest item of paper data is set (S515), and the data is similarly checked.

In this way, the oldest effective paper data of the DUP feed outlet is retrieved, whereon this data is nullified (S517).

On the other hand, in the case where the sensor SE7 for detecting passage of paper on an accommodation path to the DUP tray 25 becoming on edge is detected (S521; YES), the feed counter 2 is decremented (S523), the oldest of the items of effective paper data as to the sheets fed from the main body side is nullified.

More specifically, the address of the oldest item of paper data is set (S525), and the data is checked for effectiveness (S531). Consequently, if it is null (S531; NO), or when it is paper data as to the paper fed from the DUP side even if effective (S533; NO), the address of the second oldest item of paper data is set (S535), and the data is similarly checked.

In this way, the oldest effective paper data of the main body feed outlet is searched for, and this paper data is nullified (S537).

Figure 15:
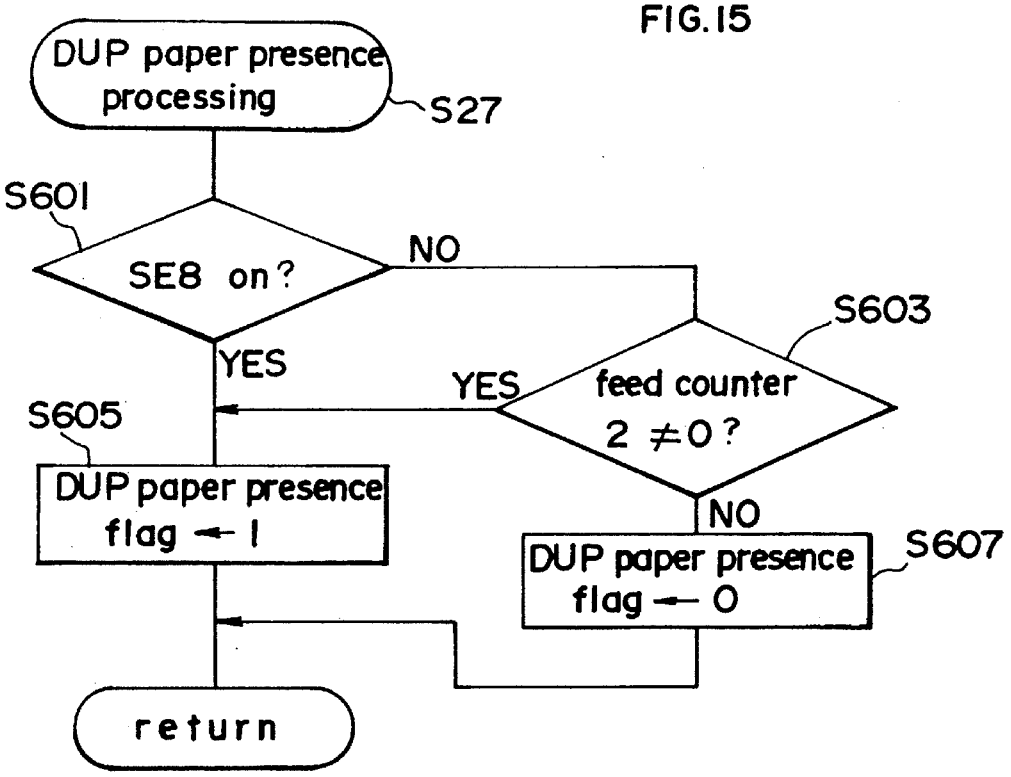
FIG. 15 is a flow chart showing a DUP paper presence processing subroutine.

(2-7) DUP Paper Presence Processing (FIG. 15)

If the sensor SE8 for detecting paper in the DUP tray 25 is on (S601; YES), the DUP paper presence flag is set to "1" (S605). While the feed counter 2 is not "0" (S603; YES) even if the sensor SE8 is off, the DUP paper presence flag is made "1" (S605). Incidentally, the expression "while the feed counter 2 is not 0" refers to the case wherein the paper to be accommodated in the DUP tray 25 is being transported.

On the other than, when the sensor SE8 is off (S601; NO) and if the feed counter 2 is "0" (S603; NO), the DUP paper presence flag is reset to "0" (S607).

Figure 16:
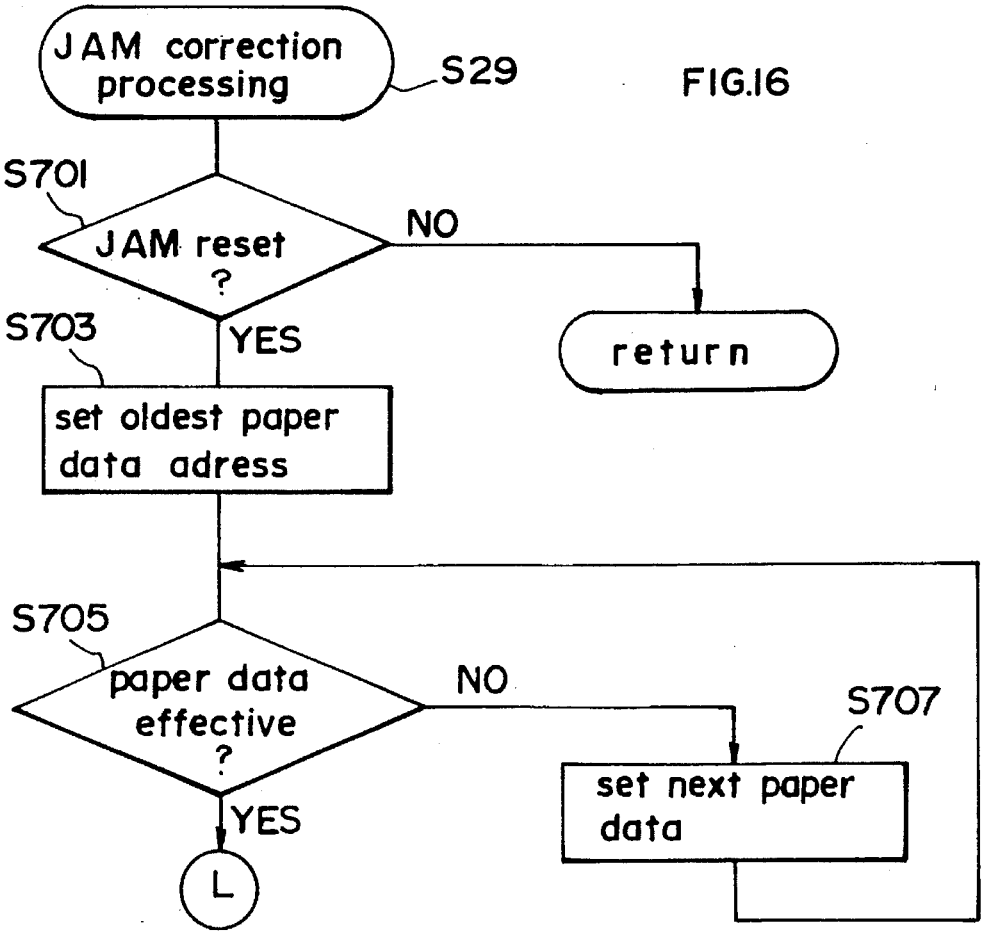
FIG. 16 is a flow chart showing a jam correction processing subroutine.
Figure 17:
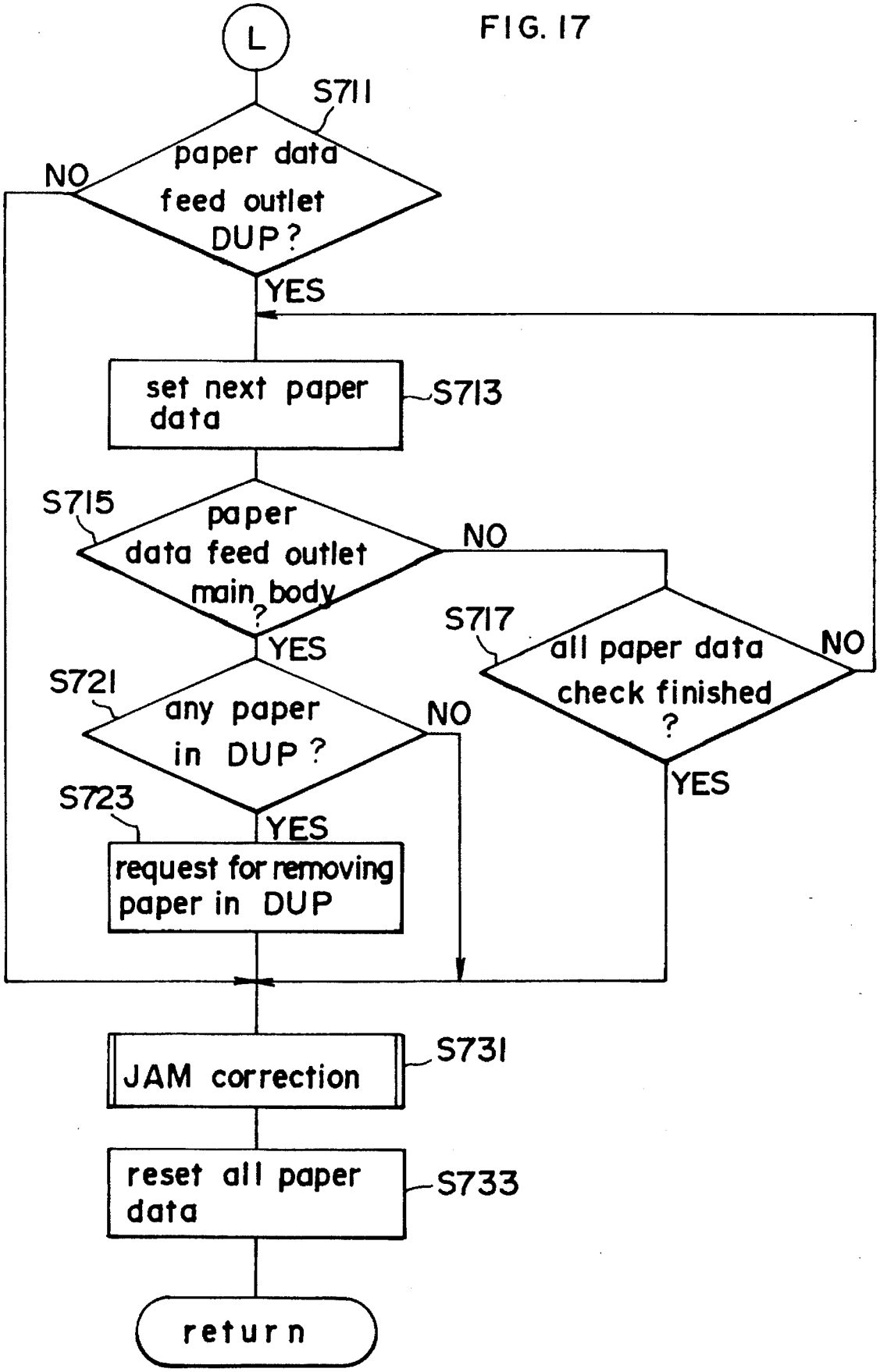
FIG. 17 is a flow chart showing the jam correction processing subroutine.

(2-8) Jam Correction Processing (FIGS. 16, 17)

In the case where paper fed from the DUP side has not been discharged from the machine and if paper fed from the main body side remains in the DUP tray 25 when an input is given by a jam reset switch, a command to remove the paper from the tray 25 is displayed.

More specifically, in corresponding relation with the input of the jam reset switch (S701; YES), the address of the oldest item of paper data is set (S703), and the data is checked for effectiveness (S705). Consequently, if it is null (S705; NO), the address of the second oldest paper data is set (S707), and the data is similarly checked (S705).

In this way, the oldest effective data is retrieved (S705; YES), whereupon the data is checked as to whether it is data concerning paper fed from the DUP side (S711).

When the oldest effective paper data is found to be data as to paper fed from the main body side (S711; NO), jam correction processing (S731) is immediately executed. In this step (S731), the number of copies and the number of return documents are processed. Further all paper data is thereafter reset (S733).

On the other hand, when the oldest effective paper data is found to be data as to paper fed from the DUP side (S711; YES), an inquiry is made as to whether the data newer than this data includes data as to paper fed from the main body side (S715, S717). When the answer is in the affirmative (S715; YES), an inquiry is made as to whether or not paper is present in the DUP tray 25 by referring to the DUP paper presence flag (S721).

Figure 19:
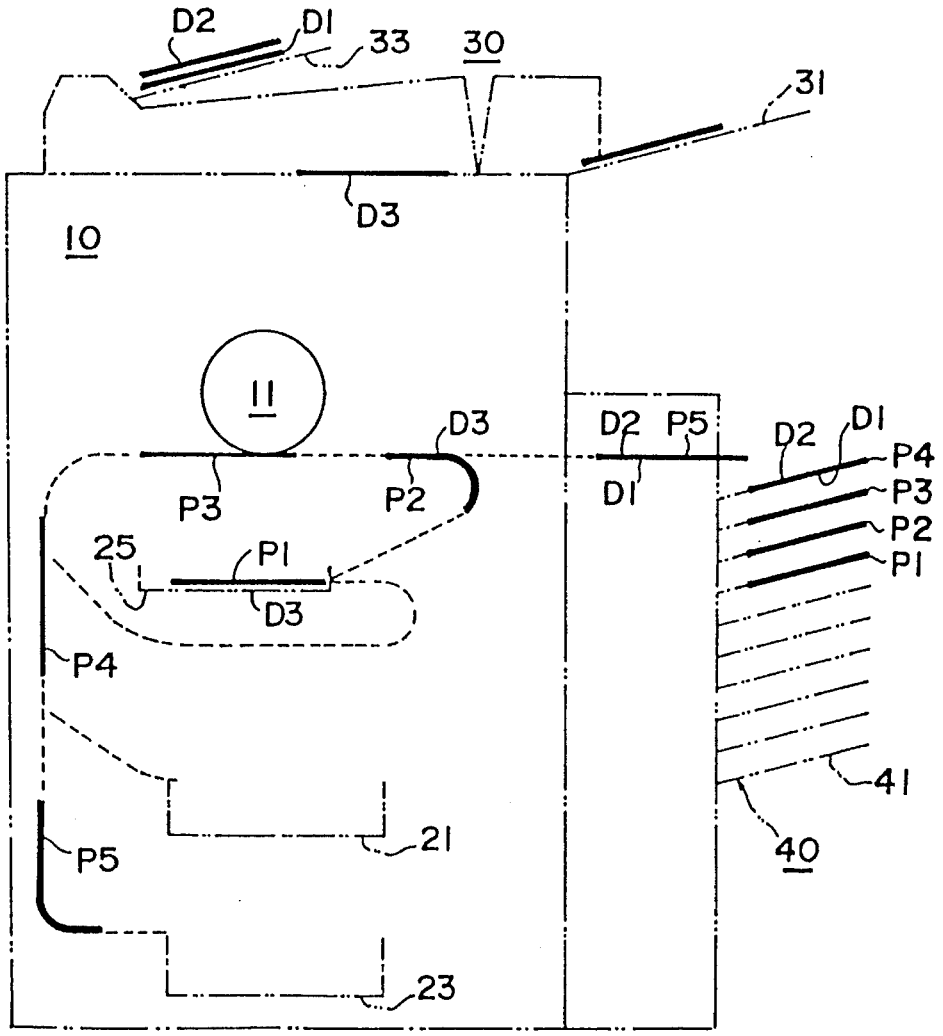
FIG. 19 is a diagram for illustrating paper data and positions of paper sheets within the copying machine.

For example with reference to FIG. 19, the fifth sheet P5 having images of documents D1, D2 on the front and rear surfaces thereof has not been discharged from the machine, so that the oldest effective data is data (5) as to paper fed from the duplex feed outlet. Further the first sheet P1 of the next cycle bearing an image of document D3 on the first surface has been accommodated in the tray 25, so that the next older paper data as compared with the above data (5) is data (1) as to paper fed from the main body feed outlet. This data is not effective. Further since the second sheet P2 bearing a copy image of document D3 on its first surface has not been placed into the intermediate tray 25, the next older paper data relative to the data (1) is data (2) as to paper fed from the main body feed outlet. This data is effective. In the case of FIG. 19, therefore, the answer to the inquiry of step S715 is in the affirmative. Since paper is present in the tray 25 in this case, the answer to the inquiry of step S721 is also affirmative.

In the case where paper is present in the DUP tray 25 (S721; YES) as stated above, an alarm is given on the display panel 51 to the effect that the paper is to be removed from the DUP tray 25, for example, as DUP 51*a* (S723). Instead of the alarm display 51*a*, the paper may be automatically discharged from the DUP tray 25.

The above-mentioned jam correction processing (S731) is thereafter effected, and all paper data is reset (S733).

The control of the present copying machine thus effected results in shortened paper feeding intervals and obviates the proglems which are likely to occur owing to the feeding intervals.

Although the embodiment described above relates to duplex copying machines, the present invention is applicable also to the production of composite copies and further to digital printers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a mode setting means for setting a duplex copy mode in which images are formed on both sides of a paper;

a feeder which feeds the paper;

an image forming device which forms an image on the paper fed by said feeder;

an intermediate container in which the paper having the image thereon is temporarily accommodated;

a refeeder which refeeds the accommodated paper from said intermediate container to form an image on the paper again;

a detector which detects presence or absence of paper to be fed by said refeeder for image formation and for outputting a signal when said detector detects the absence of paper to be refed; and a controller for effecting a change-over from the paper feeding operation by said refeeder to the paper feeding operation by said feeder in response to detection of the signal while maintaining said apparatus in said duplex copy mode when the duplex copy mode is set by said mode setting means.

2. An image forming apparatus as defined in claim 1, wherein said detector detects presence or absence of paper accommodated in said intermediate container.

3. An image forming apparatus as defined in claim 2, wherein said refeeder refeeds the paper for forming an image on a different surface of the paper than the image formed by said image forming device.

4. An image forming apparatus as defined in claim 2, wherein said refeeder refeeds the paper for forming an image on a same surface of the paper as the image formed by said image forming device.

5. An image forming apparatus as defined in claim 1, wherein said detector detects the absence of paper by counting a number of the paper accommodated in said intermediate container and a number of the paper fed from said intermediate container.

6. An image forming apparatus as defined in claim 5, wherein said detector detects the absence of the paper when the number of the paper contained in said intermediate container is equal to the number of the paper fed from said intermediate container.

7. An image forming apparatus as defined in claim 1, wherein said detector includes a first detector for detecting a trouble of said apparatus;

a second detector for detecting that the refed paper has been discharged out of said apparatus; and a third detector for detecting that the paper fed by said feeder has been accommodated in said intermediate container;

wherein said controller executes an operation stimulating discharge of the paper accommdated in said intermediate container when said first detector detects a trouble of said apparatus before said second detector detects that the refed papaer has been discharged out of said apparatus is said third detector detects that the paper has been accommodated in said intermediate container.

8. An image forming apparatus as defined in claim 7, wherein the operation executed by said controller is to automatically discharge the paper accommodated in said intermediate container.

9. An image forming apparatus as defined in claim 7, wherein the operation executed by said controller is to alarm.

10. An image forming apparatus comprising:

a feeder which feeds a paper;

an image forming device which forms an image on the paper fed by said feeder;

an intermediate container for temporarily accommodating the paper fed by said feeder and having the image thereon;

a refeeder which refeeds the accommodated paper from said intermediate container to form an image on the paper again;

a detector which detects presence or absence of paper to be fed by said refeeder for image formation; and a controller for forbidding the paper feeding operation by said feeder until said detector detects the absence of paper to be refed after the paper has been accommodated in said intermediate container, wherein said detector detects the absence of paper by counting a number of the paper accommodated in said intermediate container and a number of the paper fed from said intermediate container.

11. An image forming apparatus as defined in claim 10, wherein said detector detects the absence of the paper when the number of the paper accommodated in said intermediate container is equal to the number of the paper fed from said intermediate container.

12. An image forming apparatus comprising:

a feeder which feeds a paper;

an image forming device which forms an image on the paper fed by said feeder;

an intermediate container for temporarily accommodating the paper fed by said feeder and having the image thereon;

a refeeder which refeeds the accommodated paper from said intermediate container to form an image on the paper again;

a detector which detects presence or absence of paper to be fed by said refeeder for image formation; and a controller for forbidding the paper feeding operation by said feeder until said detector detects the absence of paper to be refed after the paper has been accommodated in said intermediate container, wherein said detector includes a first detector for detecting a trouble of said apparatus;

a second detector for detecting that the refed paper has been discharged out of said apparatus; and a third detector for detecting that the paper fed by said feeder has been accommodated in said intermediate container;

wherein said controller executes an operation stimulating discharge of the paper accommodated in said intermediate container when said first detector detects a trouble of said apparatus before said second detector detects that the refed paper has been discharged out of said apparatus if said third detector detects that the paper has been accommodated in said intermediate container.

13. An image forming apparatus as defined in claim 12, wherein the operation executed by said controller is to automatically discharge the paper accommodated in said intermediate container.

14. An image forming apparatus as defined in claim 12, wherein the operation executed by said controller is to alarm.

* * * * *

UNITED STATES PATENT AND TRADEMARK OFFICE

CERTIFICATE OF CORRECTION

PATENT NO. : 5,557,391

DATED : September 17, 1996

INVENTOR(S) : Tomokazu Kato, et al.

It is certified that error appears in the above-indentified patent and that said Letters Patent is hereby corrected as shown below:

Col. 2, line 7, change "FIG. 19" to --FIGS. 19(a) and 19(b)--.

Col. 3, line 31, change "FIG. 19 is a diagram" to --FIGS. 19(a) and 19(b) are diagrams--.

Col. 3, line 54, change "documents" to --document--.

Col. 4, line 15, delete "e".

Col. 6, line 43, change "dimplex" to --simplex--.

Col. 6, line 58, change "Whether" to --whether--.

Col. 8, line 13, change "Pi" to --Pl--.

Col. 9, line 24, change "than" to --hand--.

Col. 9, line 56, change "FIG. 19" to --FIGS. 19(a) and 19(b)--.

Col. 10, line 16, change "proglems" to --problems--.

Col. 11, line 18 (Claim 7, line 13), change "papaer" to --paper--.

Col. 11, line 19 (Claim 7, line 14), change "is" to --if--.

Signed and Sealed this

Twenty-sixth Day of November 1996

*Attest:*

Bruce Lehman

BRUCE LEHMAN

*Attesting Officer*

*Commissioner of Patents and Trademarks*